US010567877B2

(12) United States Patent
Nam et al.

(10) Patent No.: US 10,567,877 B2
(45) Date of Patent: Feb. 18, 2020

(54) METHOD AND ELECTRONIC DEVICE FOR PLAYING AUDIO DATA USING DUAL SPEAKER

(71) Applicant: Samsung Electronics Co., Ltd., Gyeonggi-do (KR)

(72) Inventors: Myoungwoo Nam, Gyeonggi-do (KR); Heejin Kim, Gyeonggi-do (KR); Ochae Kwon, Gyeonggi-do (KR); Chulwoo Kim, Gyeonggi-do (KR); Joongsam Yun, Gyeonggi-do (KR); Younghak Oh, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 16/270,175

(22) Filed: Feb. 7, 2019

(65) Prior Publication Data

US 2019/0246208 A1 Aug. 8, 2019

(30) Foreign Application Priority Data

Feb. 7, 2018 (KR) ..... 10-2018-0015212

(51) Int. Cl.
*H04R 3/12* (2006.01)
*H04R 5/02* (2006.01)
*H04R 5/04* (2006.01)

(52) U.S. Cl.
CPC ..... *H04R 3/12* (2013.01); *H04R 5/02* (2013.01); *H04R 5/04* (2013.01); *H04R 2499/11* (2013.01)

(58) Field of Classification Search
CPC ..... H04R 2499/11; H04R 5/02; H04R 5/04; H04R 2420/03; H04R 3/12;
(Continued)

(56) References Cited

U.S. PATENT DOCUMENTS 8,879,761 B2 * 11/2014 Johnson ..... H04R 3/12 381/306
9,241,217 B2 * 1/2016 Rodgers ..... H04R 5/02
(Continued)

FOREIGN PATENT DOCUMENTS

KR 1020150054835 5/2015
KR 1020180006798 1/2018

OTHER PUBLICATIONS

International Search Report dated May 7, 2019 issued in counterpart application No. PCT/KR2019/001389, 7 pages.

*Primary Examiner* — Kile O Blair
(74) *Attorney, Agent, or Firm* — The Farrell Law Firm, P.C.

(57) ABSTRACT

An electronic device, method, and non-transitory computer-readable recording medium are provided. Electronic device includes first speaker and second speaker arranged in electronic device, processor operatively connected with first speaker and second speaker, and memory operatively connected to the processor, wherein the memory is configured to store instructions executed to enable the processor to detect an orientation or attitude of the electronic device while playing first channel audio data and second channel audio data via the first speaker and the second speaker, and based on at least part of the detected orientation or attitude of the electronic device, keep outputting a first frequency component of the first channel audio data and a second frequency component of the second channel audio data via the first speaker and the second speaker and switch a second frequency component of the first channel audio data and a first frequency component of the second channel audio data.

20 Claims, 15 Drawing Sheets

(58) Field of Classification Search
CPC ..... H04R 2420/01; H04R 2499/15; H04R 1/227; G06F 3/165; G06F 2200/1614; G06F 1/1688; G06F 2200/1637; H04M 2250/12; H04S 7/30; H04S 1/00; H04S 7/302; H04S 7/307
See application file for complete search history.

(56) References Cited

U.S. PATENT DOCUMENTS

| | | | | |
|---|---|---|---|---|
| 2007/0005161 | A1 | 1/2007 | Henson et al. | |
| 2012/0051567 | A1 | 3/2012 | Castor-Perry | |
| 2014/0233770 | A1* | 8/2014 | Giustina ..... | H04R 5/04 381/304 |
| 2015/0023533 | A1 | 1/2015 | Johnson et al. | |
| 2015/0256934 | A1 | 9/2015 | Brockmole | |
| 2016/0381483 | A1 | 12/2016 | Robinson et al. | |

* cited by examiner

METHOD AND ELECTRONIC DEVICE FOR PLAYING AUDIO DATA USING DUAL SPEAKER

CROSS-REFERENCE TO RELATED APPLICATION(S)

This application is based on and claims priority under 35 U.S.C. § 119 to Korean Patent Application No. 10-2018-0015212, filed on Feb. 7, 2018, in the Korean Intellectual Property Office, the disclosure of which is incorporated by reference herein in its entirety.

BACKGROUND

1. Field

The disclosure relates to methods and electronic devices for playing audio data via a dual speaker.

2. Description of the Related Art

Recently developed electronic devices provide various functionalities, and among others, playing audio is popular. Audio devices, e.g., Bluetooth audio, smartphones, or other audio-playable portable devices pack a dual speaker, delivering stereoscopic sound effects.

Generally, a dual speaker-equipped audio device outputs left channel audio data via the left-hand speaker which is on a left side of a user and right channel audio data via a right-hand speaker in order to provide a better sound stage (e.g., sound fields including the width, height, depth, or directivity of sound in play) of audio played via the dual speaker. Audio data sounds output from the left-hand and right-hand speakers of the user may be combined into a stereoscopic sound.

An electronic device may have a dual speaker at one end thereof along a landscape orientation. When a user changes an orientation of an electronic device from a landscape orientation to a portrait orientation while playing audio data, the output of sound may stop during reorientation and may resume when reorientation is complete. For example, an electronic device in a portrait orientation may play sound via one of speakers but may stop playing, or play at a very low volume, sound via another speaker.

SUMMARY

An aspect of the present disclosure provides a method and an electronic device for playing audio data using a dual speaker which enables smooth reorientation of the electronic device without sound dropouts upon reorienting the electronic device while playing audio data.

Another aspect of the present disclosure provides a method and an electronic device for playing audio data using a dual speaker which may deliver stereoscopic sound effects by playing sound without sound dropouts while reorienting the electronic device.

In accordance with an aspect of the present disclosure, an electronic device is provided. The electronic device includes a first speaker and a second speaker arranged in the electronic device, a processor operatively connected with the first speaker and the second speaker, and a memory operatively connected to the processor, wherein the memory is configured to store instructions executed to enable the processor to detect the orientation or attitude of the electronic device while playing first channel audio data and second channel audio data via the first speaker and the second speaker, and based on at least part of the detected orientation or attitude of the electronic device, keep outputting a first frequency component of the first channel audio data and a second frequency component of the second channel audio data via the first speaker and the second speaker, and switch a second frequency component of the first channel audio data and a first frequency component of the second channel audio data.

In accordance with another aspect of the present disclosure, a method for playing audio data on an electronic device is provided. The method includes detecting the orientation or attitude of the electronic device while playing first channel audio data and second channel audio data via the first speaker and the second speaker, based on at least part of the detected orientation or attitude of the electronic device, keeping outputting a first frequency component of the first channel audio data and a second frequency component of the second channel audio data via the first speaker and the second speaker, and switching a second frequency component of the first channel audio data and a first frequency component of the second channel audio data.

In accordance with another aspect of the present disclosure, a non-transitory computer-readable recording medium recording a program running on a computer is provided. The program includes instructions executable by a processor to enable the processor to detect an orientation or attitude of an electronic device while playing first channel audio data and second channel audio data via a first speaker and a second speaker of the electronic device, based on at least part of the detected orientation or attitude of the electronic device, keep outputting a first frequency component of the first channel audio data and a second frequency component of the second channel audio data via the first speaker and the second speaker, and switch a second frequency component of the first channel audio data and a first frequency component of the second channel audio data.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
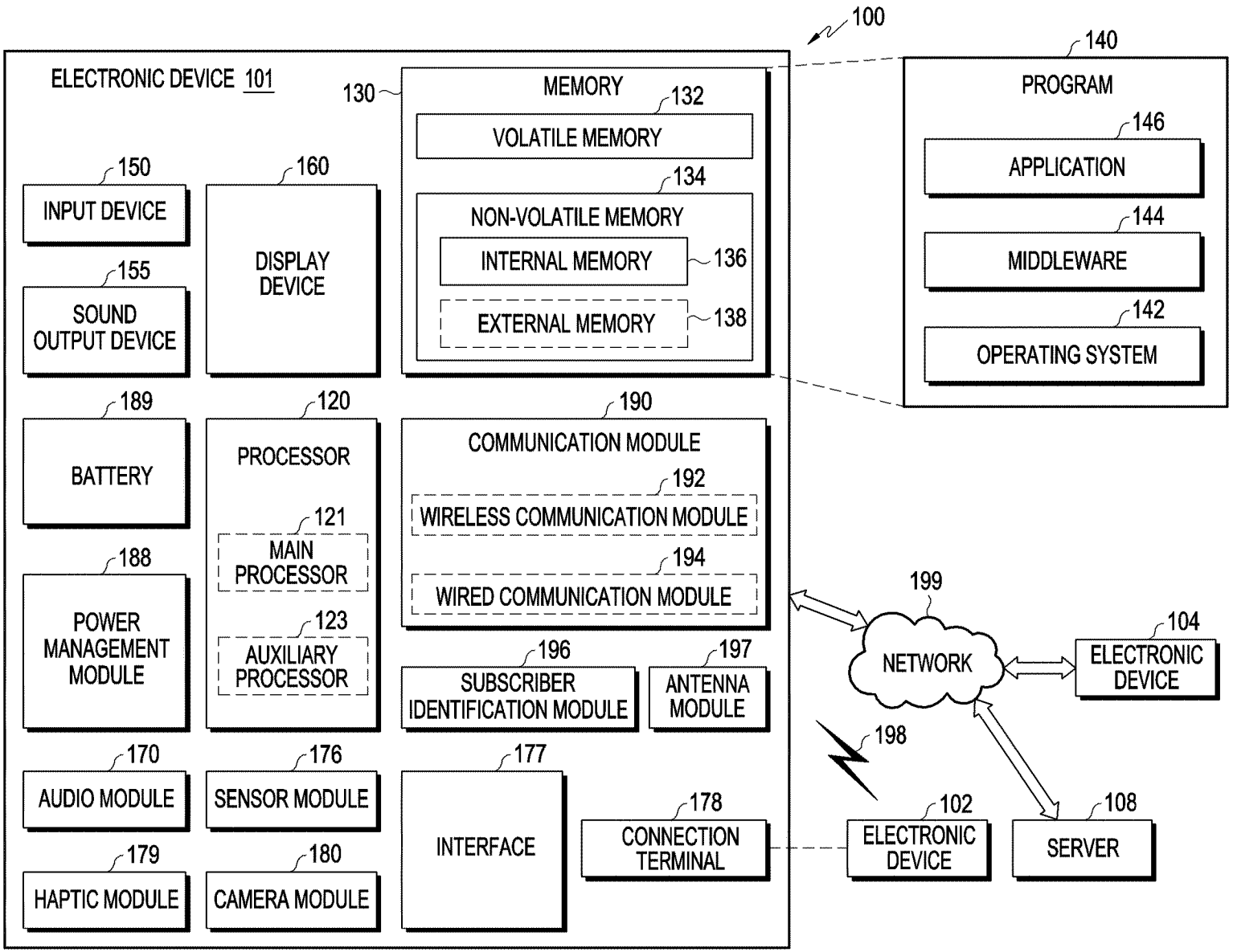
FIG. 1 is a block diagram of an electronic device in a network environment according to an embodiment.

FIG. 1 is a block diagram illustrating an electronic device 101 in a network environment 100 according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. The electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. At least one (e.g., the display device 160 or the camera module 180) of the components may be omitted from the electronic device 101, or one or more other components may be added in the electronic device 101. Some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, e.g., software (e.g., a program 140) to control at least one other component (e.g., a hardware or software component) of the electronic device 101 connected with the processor 120 and may process or compute various data. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one (e.g., the display device 160, the sensor module 176, or the communication module 190) of the components of the electronic device 101, instead of the main processor 121 while the main processor 121 is in an inactive (e.g., sleep) state or along with the main processor 121 while the main processor 121 is an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain a sound via the input device 150 or output a sound via the sound output device 155 or the electronic device 102 (e.g., a speaker or a headphone) directly or wirelessly connected with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). According to an embodiment, the connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or wireless communication channel between the electronic device 101 and the electronic device 102, the electronic device 104, or the server 108 and performing communication through the established communication channel. The communication module 190 may include one or more communication processors that are operable independently from the processor 120 (e.g., the AP) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or a standard of the Infrared Data Association (IrDA)) or the second network 199 (e.g., a long-range communication network, such as a cellular network, the Internet, or a computer network (e.g., LAN or wide area network (WAN)). These various types of communication modules may be implemented as a single component (e.g., a single integrated circuit or chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. The first and second external electronic devices 102 and 104 each may be a device of the same or a different type from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
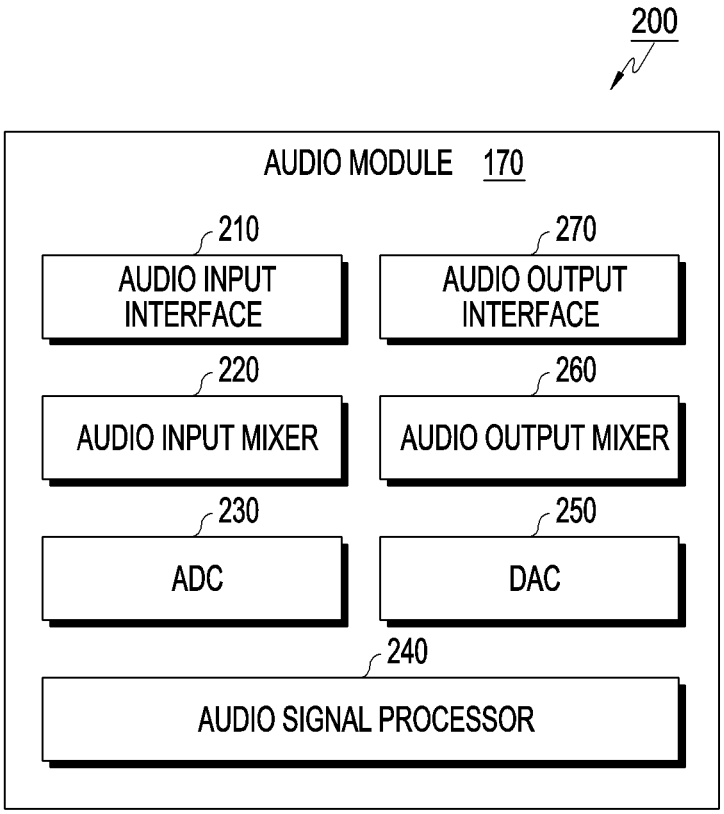
FIG. 2 is a block diagram of an audio module according to an embodiment.

FIG. 2 is a block diagram 200 illustrating the audio module 170 according to various embodiments.

Referring to FIG. 2, the audio module 170 may include, for example, an audio input interface 210, an audio input mixer 220, an analog-to-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connection terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. Additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. One or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor 120 or the memory 130) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. The audio output interface 270 may be connected with the external electronic device 102 (e.g., an external speaker or a headset) directly via the connection terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (e.g., a speaker amplifying circuit) that is capable of amplifying an analog audio signal inputted via the audio input interface 210 or an audio signal that is to be outputted via the audio output interface 270. The audio amplifier may be configured as a module separate from the audio module 170.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. However, the electronic device is not limited to the above-listed embodiments.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to;" "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 3A:
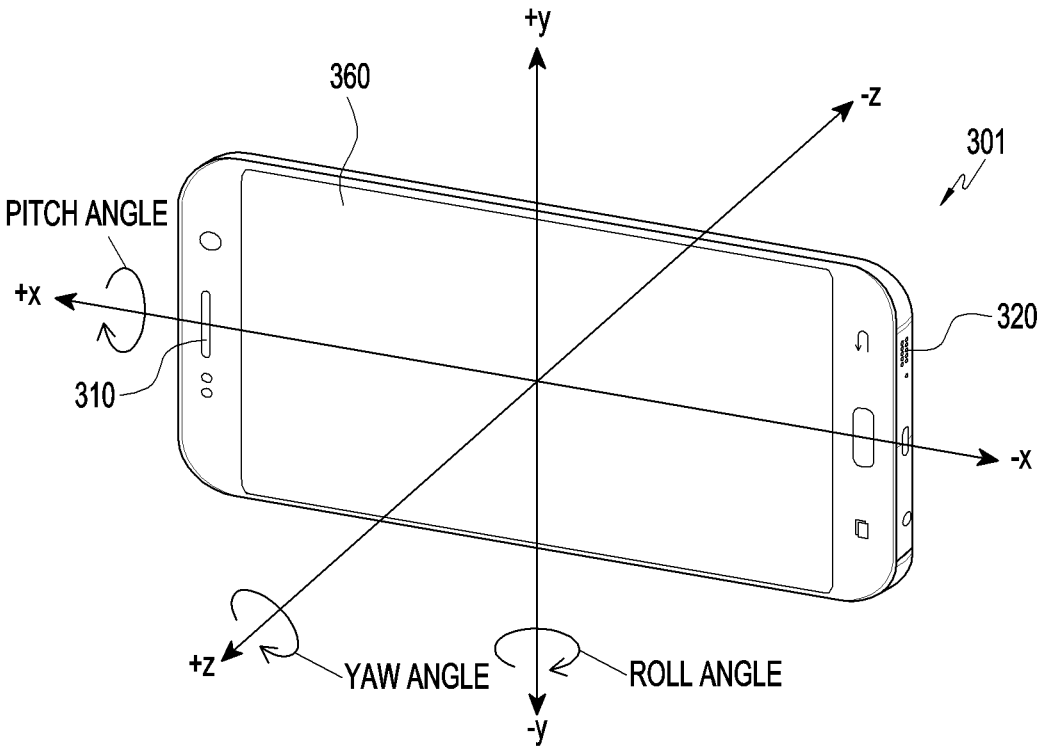
FIG. 3A is an illustration of an electronic device according to an embodiment.

FIG. 3A is an illustration of a reference orientation of an electronic device according to an embodiment.

Referring to FIG. 3A, an electronic device 301 may include at least one sensor capable of detecting an orientation or attitude of the electronic device 301. For example, the electronic device 301 may include at least one of a geo-magnetic sensor or a gyro sensor. The sensor is not limited thereto but may rather include various orientation or attitude based sensors, e.g., acceleration sensors or angular speed sensors.

Referring to FIG. 3A, the sensor may have three axes: a first axis (an x axis) passing through a center of the electronic device 301 and parallel with the longer sides of the electronic device 301; a second axis (a y axis) passing through the center of the electronic device 301 and parallel with the shorter sides of the electronic device 301; and a third axis (a z axis) passing through the center of the electronic device 301 and perpendicular to the xy plane (e.g., the display 360 or the screen of the display device 160). According to an embodiment, the x, y, and z axes of the electronic device 301 may be set as reference orientations, with the y axis perpendicular to the ground, and the x and z axes parallel with the ground.

According to an embodiment, the sensor may have the following orientations: +y axis (where the opposite is a −y axis) oriented up from the center of the electronic device 301; +x axis (where the opposite is a −x axis) oriented left from the center of the electronic device 301, and +z axis (where the opposite is a −z axis) oriented forward (e.g., ahead of a screen of the display 360) from the center of the electronic device 301.

According to an embodiment, when the sensor is a geo-magnetic sensor, the geo-magnetic sensor may detect the geo-magnetic orientation of the electronic device 301 by Earth's magnetic field at a measurement point where the electronic device 301 is located. The geo-magnetic sensor may have the same three axes (x axis, y axis, and z axis) as those shown in FIG. 3A and may have a reference orientation in which the rotation angle or assumed azimuth of each axis of the electronic device 301 is 0° when the y axis is perpendicular to the ground and while the x axis and z axis are parallel with the ground.

The rotation angle of each axis may be an angle at which the electronic device changes around the axis, and the respective rotation angles of the x, y, and z axes may be denoted a pitch angle, roll angle, and yaw angle, respectively.

The assumed azimuth is a horizontal angle at which the electronic device 301 is turned clockwise around one axis parallel with a certain reference surface of the electronic device 301. According to an embodiment the xy plane may be a reference surface, where the x axis parallel with the reference is a reference axis, and the horizontal angle at which the electronic device turns clockwise around the x axis on the reference surface is the assumed azimuth of the electronic device 301.

According to an embodiment, although the assumed azimuth of the electronic device 301 may be the angle of the +x axis (e.g., +x axis=0° to 360°), this refers to the horizontal angle at which the electronic device turns clockwise on the reference surface around the +x axis (e.g., +x axis=0°) of the electronic device 301 in the reference orientation or reference attitude.

According to an embodiment, when the sensor is a gyro sensor, the gyro sensor may detect the angular speed of the electronic device 301 at a measurement point where the electronic device 301 is located. The gyro sensor may have the same three axes (x axis, y axis, and z axis) as those shown in FIG. 3A, and as described above in connection with the geo-magnetic sensor, may have a reference orientation in which the rotation angle or assumed azimuth of each axis of the electronic device 301 is 0° when the y axis is perpendicular to the ground while the x axis and z axis are parallel with the ground.

The electronic device 301 may recognize or detect the orientation or attitude of the electronic device 301 via the rotation angle, assumed azimuth, or attitude angle of each axis of the electronic device 301 which is yielded based on sensing values (e.g., geo-magnetic sensing values or gyro sensing values) by the sensor (e.g., a geo-magnetic sensor or gyro sensor).

Figure 3B:
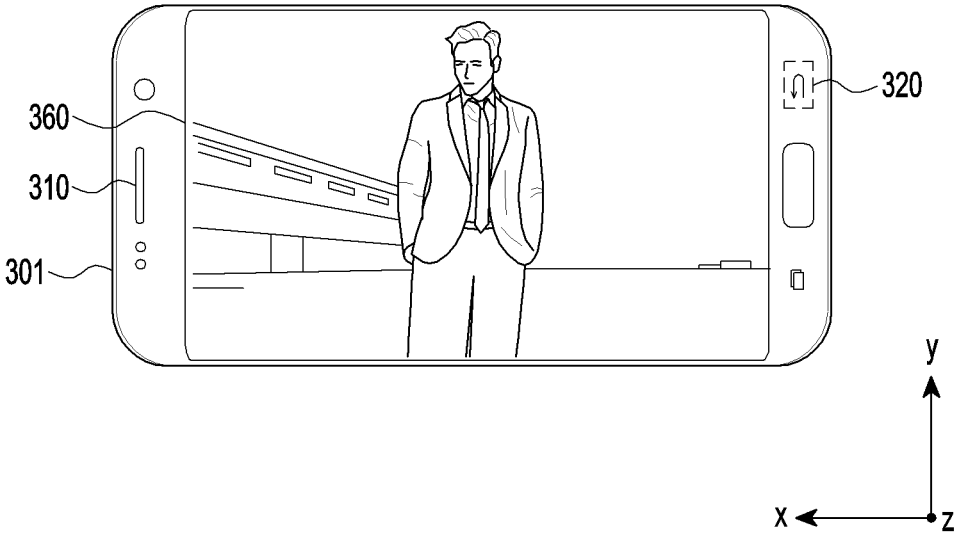
FIGS. 3B and 3C are illustrations of an electronic device according to an embodiment.
Figure 3C:
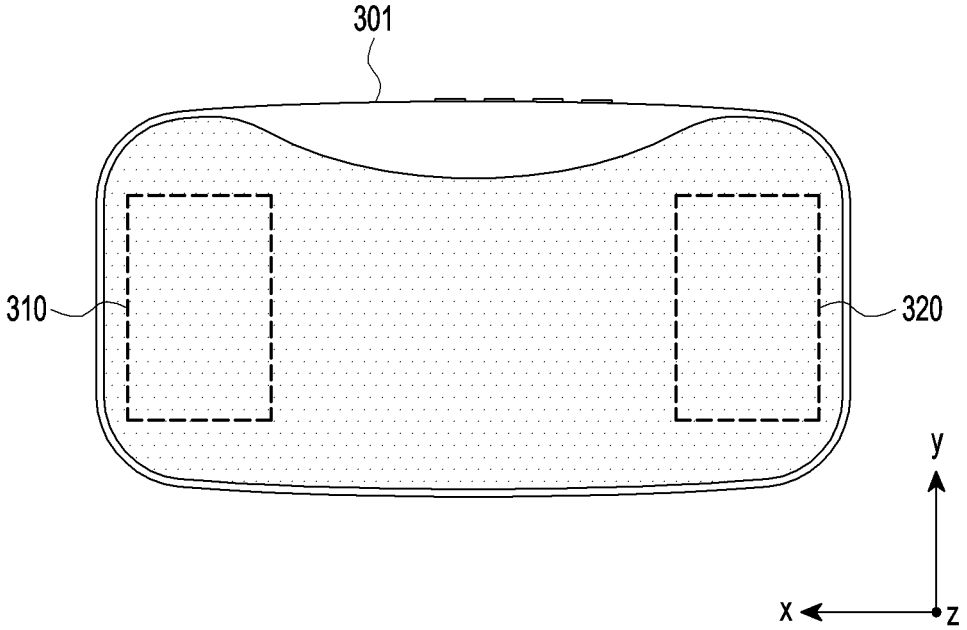

FIGS. 3B and 3C are front views illustrating an electronic device according to an embodiment. The electronic device 301 of FIGS. 3B and 3C may include at least one sensor with the same three axes, x, y, and z axes, as those of the electronic device of FIG. 3A, and may recognize or detect its orientation or attitude using the sensor as described above in connection with FIG. 3A.

Referring to FIGS. 3B and 3C, the electronic device 301 may have a first speaker 310 and a second speaker 320 placed along the landscape orientation of the electronic device 301. For example, when the electronic device 301 is positioned in the reference orientation (or position) (e.g., when a user places the electronic device 301 in the landscape orientation while facing the display 360), the first speaker 310 or the second speaker 320 is placed on the left side (along the +x axis) of the electronic device 301 as viewed from the user, and the other of the first speaker 310 or the second speaker 320 is placed on the right side (along the −x axis) of the electronic device 301 as viewed from the user. According to an embodiment, the electronic device 301 may be an electronic device (e.g., a smartphone) equipped with a display 360 as shown in FIG. 3B. Alternatively, the electronic device 301 may be an electronic device (e.g., a Bluetooth audio device) with no display as shown in FIG. 3C.

The electronic device 301 may have the first speaker 310 (e.g., a first channel speaker) in an end thereof on the +x axis and the second speaker 320 (e.g., a second channel speaker) in the opposite end on the −x axis. The placement of the first speaker 310 or the second speaker 320 is not limited to a certain end. Although two speakers 310 and 320 are shown and described below in connection with various embodiments, embodiments of the present disclosure may likewise apply when three or more speakers are provided.

The electronic device 301 may output first channel audio data corresponding to the first speaker 310 via the first speaker 310 and second channel audio data corresponding to the second speaker 320 via the second speaker 320.

The first channel audio data may be a signal containing a left audio source, and the second channel audio data may be a signal containing a right audio source.

The electronic device 301 may detect its orientation or position via the sensor while outputting the first channel audio data and the second channel audio data via the first speaker 310 and the second speaker 320. The electronic device 301 may identify the first axis (e.g., +x axis)-based assumed azimuth (e.g., 0° to 360°) based on at least part of the detected orientation or position of the electronic device 301.

For example, when the +x axis is at 0°, the electronic device 301 may determine that it is in a first landscape orientation. When the +x axis is at 90°, the electronic device 301 may determine that it is in a first portrait orientation. When the +x axis is at 180°, the electronic device 301 may determine that it is in a second landscape orientation. When the +x axis is at 270°, the electronic device 301 may determine that it is in a second portrait orientation. When the +x axis is at 360°, the electronic device 301 may determine that it has been rotated clockwise 360-degrees to the position where the +x axis is back at 0°. According to an embodiment, the electronic device 301 may set the first landscape orientation, in which the +x axis is at 0°, as the reference orientation or reference position.

Figure 4A:
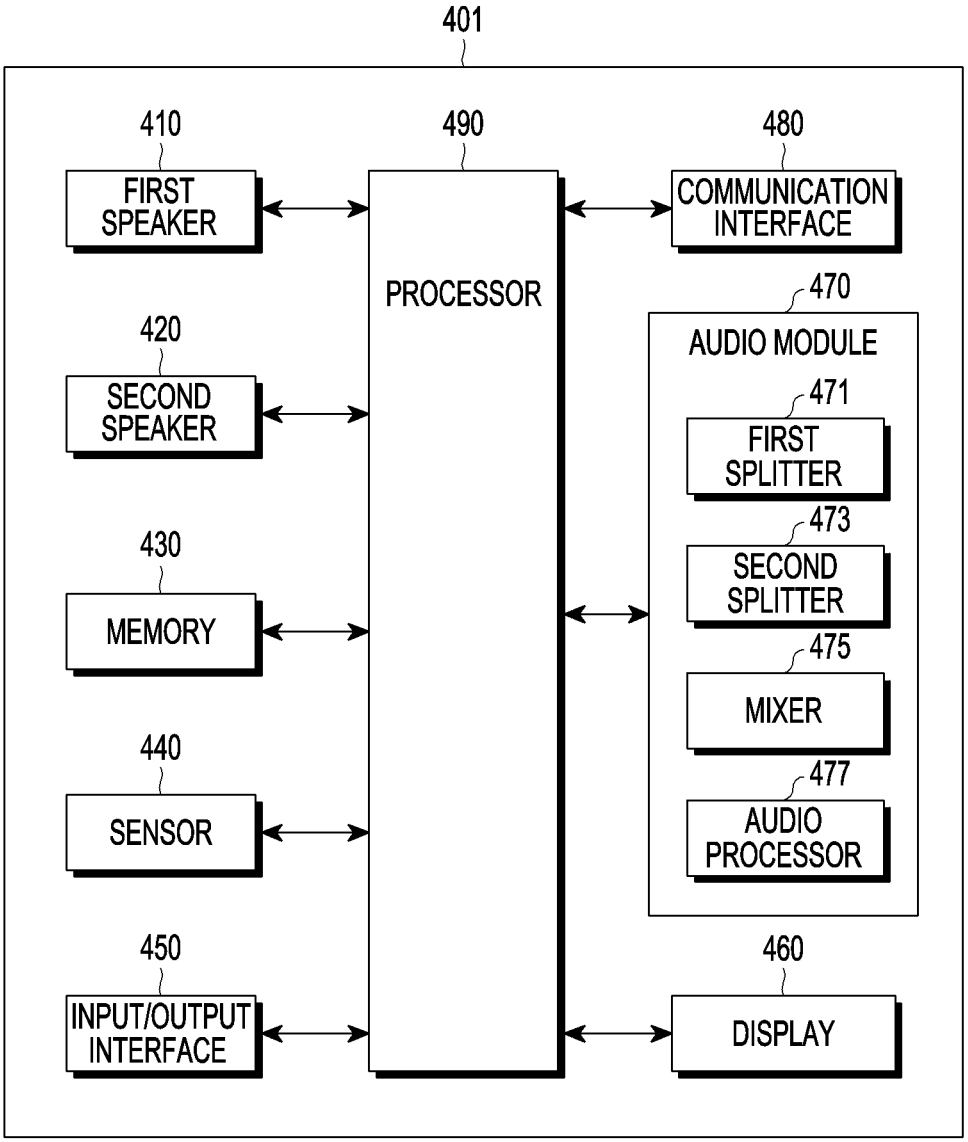
FIG. 4A is a block diagram of an electronic device according to an embodiment.
Figure 4B:
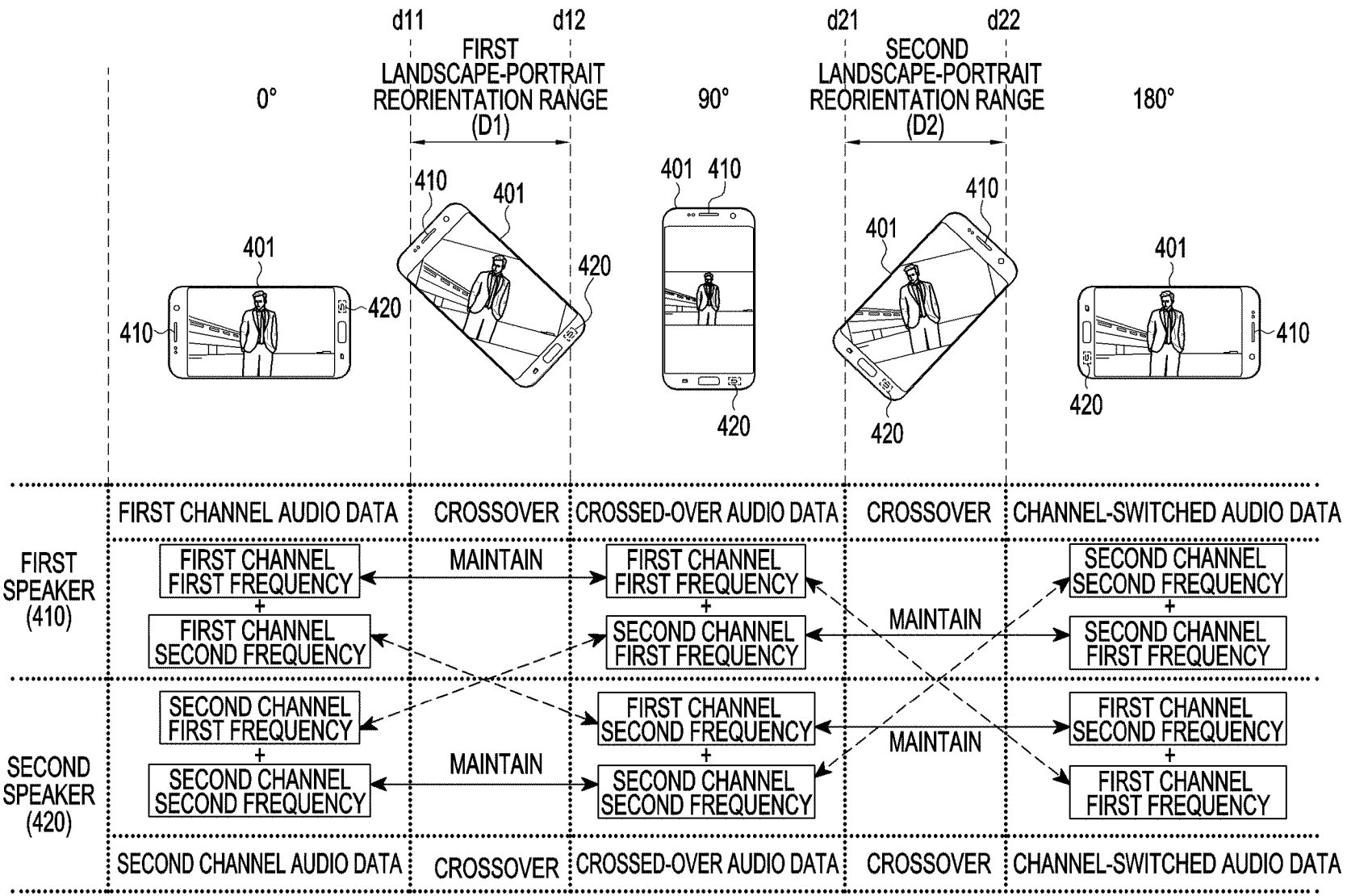
FIGS. 4B and 4C are illustrations of a method for playing audio as an electronic device changes its orientation according to an embodiment.
Figure 4C:
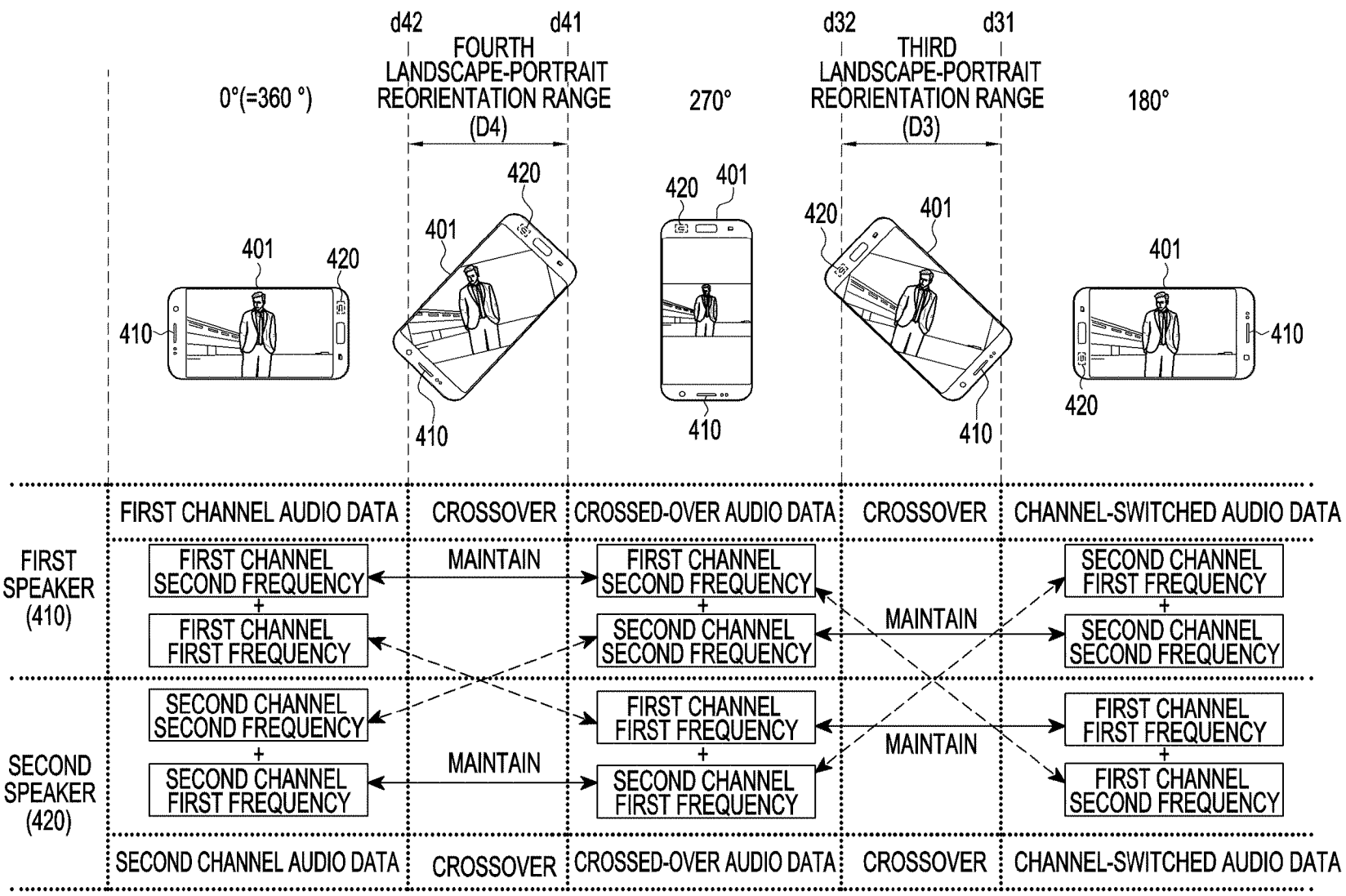

FIG. 4A is a block diagram of an electronic device according to an embodiment. FIGS. 4B and 4C are illustrations of a method for playing audio as an electronic device changes its orientation according to an embodiment.

Referring to FIG. 4A, an electronic device 401 may include at least one of a first speaker 410, a second speaker 420, a memory 430, a sensor 440, an input/output interface 450, a display 460, an audio module 470, a communication interface 480, or a processor 490. FIG. 4A illustrates an example in which the electronic device 401 includes at least one component related to embodiments of the present disclosure is included, where the electronic device 401 may include other components. For example, the electronic device 401 of FIGS. 4A to 4C may include the whole or part of the electronic device 101 of FIG. 1 or the whole or part of the electronic device 301 of FIGS. 3A to 3C.

The first speaker 410 and the second speaker 420 are sound signal output devices and may include the whole or part of the sound output device 155 of FIG. 1. According to an embodiment, each of the first speaker 410 and the second speaker 420 may be placed at one end of the electronic device 401. For example, the first speaker 410 may be disposed on one side (e.g., a left side) of the electronic device 401 along a landscape orientation (e.g., a +x axis) of the electronic device 410, and the second speaker 420 on the opposite side (e.g., a right side) of the electronic device 401 along the opposite landscape orientation (e.g., a −x orientation) of the electronic device 401.

The first speaker 410 may be a first channel speaker (e.g., a left-hand speaker) corresponding to a first channel, and the second speaker 420 may be a second channel speaker (e.g., a right-hand speaker) corresponding to a second channel. For example, when the electronic device 401 plays audio data including first channel audio data and second channel audio data in the landscape orientation (e.g., the first landscape orientation where +x axis=0°), the first channel audio data and the second channel audio data may be output via the first speaker 410 and the second speaker 420, respectively. As outputting different channels of audio data, the first speaker 410 and the second speaker 420 may be used as a dual speaker capable of implementing stereoscopic sounds.

The first channel audio data may include a first frequency component and a second frequency component, and the second channel audio data may include a first frequency component and a second frequency component. The first frequency components may be high-tone (or high frequency) components of the channel audio data, and the second frequency components may be low-tone (or low frequency) components of the channel audio data.

The memory 430 may include the whole or part of the memory 130 of FIG. 1. The memory 430 may store at least one piece of audio data. For example, the memory 430 may contain audio data including the first channel audio data and the second channel audio data. The memory 430 may store at least one piece of audio data entered or downloaded from the outside. The memory 430 may store various temporary computational values created while outputting audio data by turning the electronic device 401 to a different orientation while playing audio data on the electronic device 401.

The sensor 440 may include the whole or part of the sensor module 176 of FIG. 1. The sensor 440 may detect sensing values related to the orientation or position of the electronic device 401. According to an embodiment, the sensor 440 may include a geo-magnetic sensor or a gyro sensor. For example, the electronic device 401 may recognize or detect the orientation or position of the electronic device 401 based on a geo-magnetic sensing value detected via a geo-magnetic sensor or a gyro sensing value detected via a gyro sensor.

The input/output interface 450 may include the whole or part of the interface 177 or the connection terminal 178 of FIG. 1. According to an embodiment, the input/output interface 450 may be an audio interface. Audio data may be input from or output to an external electronic device wiredly or wirelessly via the input/output interface 450.

The display 460 may include the whole or part of the display device 160 of FIG. 1. The display 460 may display at least one piece of visual data or a graphical user interface. The screen of the display 460 or a user interface on the screen may change its orientation into the portrait orientation or landscape orientation as the electronic device 401 changes its orientation. The screen reorientation of the display 460 may be associated with the crossover of the first channel audio data and the second channel audio data performed by the first speaker 410 and the second speaker 420 as the electronic device 401 changes its orientation.

The audio module 470 may include the whole or part of the audio module 170 of FIG. 1 or the whole or part of the audio module 170 of FIG. 2. According to an embodiment, the audio module 470 may include at least one of a first splitter 471, a second splitter 473, a mixer 475, or an audio processor 477.

The first splitter 471 and the second splitter 473 may split the first channel audio data or the second channel audio data contained in the audio data. According to an embodiment, the first splitter 471 and the second splitter 473 may split the first channel audio data into the first frequency component and the second frequency component and the first channel audio data into the first frequency component and the second frequency component. For example, the electronic device 401 may split the first frequency component off from the first channel audio data using the first splitter 471 and the second frequency component off from the first channel audio data using the second splitter 473. Further, the electronic device 401 may split the first frequency component off from the channel audio data using the first splitter 471 and the second frequency component off from the second channel audio data using the second splitter 473. According to an embodiment, the first splitter 471 may be a high pass filter (HPF), and the second splitter 473 may be a low pass filter (LPF).

The mixer 475 may merge a plurality of pieces of audio data input or to be output.

The audio processor 477 may perform various processes on audio data. According to an embodiment, the audio processor 477 may variously mix (e.g., crossover) the first frequency components and the second frequency components of the first channel audio data and the second channel audio data as the electronic device 401 changes its orientation (or position) while playing the first channel audio data and the second channel audio data via the first speaker 410 and the second speaker 420. At least some functions of the audio processor 477 may be included in or integrated with the processor 490. Although FIG. 4A illustrates an example in which the audio module 470 is configured separately from the processor 490, embodiments of the present disclosure are not limited thereto, and the audio module 470 may be included in or integrated with the processor 490. At least some of the components (e.g., the first splitter 471, the second splitter 473, the mixer 475, or the audio processor 477) may be configured in hardware or software.

The processor 490 may include the whole or part of the processor 120 of FIG. 1 and may provide overall control of the electronic device 401. The processor 490 may include the audio module 470, may control it to perform various crossovers on first channel audio data and second channel audio data as the electronic device 401 changes its orientation (or position) while playing the first channel audio data and the second channel audio data via the first speaker 410 and the second speaker 420, and may output the resulting data via the first speaker 410 and the second speaker 420.

The processor 490 may play the first channel audio data and the second channel audio data via the first speaker 410 and the second speaker 420.

The first channel audio data may include a first frequency component and a second frequency component, and the second channel audio data may include a first frequency component and a second frequency component. The first frequency components may be high-tone (or high frequency) components of the channel audio data, and the second frequency components may be low-tone (or low frequency) components of the channel audio data.

The processor 490 may detect the orientation or position of the electronic device 401 while playing the first channel audio data and the second channel audio data via the first speaker 410 and the second speaker 420. According to an embodiment, the processor 490 may yield or detect the rotation angle (e.g., the pitch angle, roll angle, or yaw angle) of each axis (e.g., the x axis, y axis, or z axis) of the electronic device 401 obtained based on sensing values (e.g., geo-magnetic sensing values or gyro sensing values) detected via the sensor 440. The processor 490 may recognize or detect the orientation or position of the electronic device 40 based on the rotation angle, assumed azimuth, or attitude angle obtained or detected from the sensor 440.

The processor 490 may keep outputting some frequency components of the first channel audio data and the second channel audio data via the first speaker 410 and the second speaker 420 while switching between the first speaker 410 and the second speaker 420 for the remaining frequency components, based on at least part of the detected orientation or position of the electronic device.

For example, when the electronic device 401 is in the reference position (e.g., the first landscape orientation (x axis=0°), the processor 490 may output the first channel audio data via the first speaker 410 and the second channel audio data via the second speaker 420. When the electronic device 401 is turned to the portrait orientation (e.g., the first portrait orientation (e.g., the first portrait orientation (e.g., x axis=90° or the second portrait orientation (e.g., x axis=270°)) while outputting the first channel audio data via the first speaker 410 and the second channel audio data via the second speaker 420, the processor 490 may perform a crossover on the first frequency components of the first channel audio data and the second channel audio data while the electronic device 401 is turned to the portrait orientation and may output the resulting data to the first speaker 410 or the second speaker 420, and perform a crossover on the second frequency components of the first channel audio data and the second channel audio data and output the resulting data to the other of the first speaker 410 or the second speaker 420.

When the electronic device 401 is in the portrait orientation, the processor 490 may output the first frequency components of the channel audio data via the first speaker 410 and the second frequency components of the channel audio data via the second speaker 420. When the electronic device 401 is in the portrait orientation, the processor 490 may output the first frequency components of the first channel audio data and the second channel audio data that result from the crossover via the second speaker 420 and the second frequency components of the first channel audio data and the second channel audio data crossed-over via the first speaker 410.

When the electronic device 401 is in the portrait orientation, a speaker may be previously set or designated by the user to output the first frequency components or second frequency components of the first channel audio data and the second channel audio data crossed-over.

The first speaker 410 is designated to output the first frequency components (e.g., high-tone components) of the channel audio data.

When the electronic device 401 changes its orientation or position, the processor 490 may determine whether to change the orientation or position of the electronic device 401 based on the degree of change in orientation or position of the electronic device 401. When the electronic device 401 varies its orientation or position, the processor 490 may calculate the variation in orientation or position of the electronic device 401 based on at least part of the orientation or position, currently recognized or detected, of the electronic device 401. For example, the processor 490 may calculate the variation in the attitude angle of the electronic device 401. The variation in the attitude angle of the electronic device 401 may be the difference between the current attitude angle of the electronic device 401 recognized or detected and the prior attitude angle of the electronic device recognized or detected.

The processor 490 may compare the variation in the attitude angle of the electronic device 401 with a threshold and determine whether the electronic device 401 changes its orientation or position between a landscape orientation and a portrait orientation, between a landscape orientation and another landscape orientation, or between a portrait orientation and another portrait orientation based on the results of the comparison.

The processor 490 may determine whether the variation in the orientation or position of the electronic device 401 is less than a threshold (or a threshold range). When the calculated variation in the attitude angle of the electronic device 401 is less than the threshold, the processor 490 may determine that the electronic device 401 changes its orientation between a landscape orientation and a portrait orientation, and when the variation is not less than the threshold, that the electronic device 401 changes its orientation between a landscape orientation and another landscape orientation or between a portrait orientation and another portrait orientation.

The threshold may range from about 130° to 140°. For example, when the threshold is set to 135° and the calculated variation in attitude angle is less than 135°, the processor 490 may determine that the electronic device 401 changes its orientation between a landscape orientation and a portrait orientation. When the calculated variation in the attitude angle is not less than 135°, the processor 490 may determine that the electronic device 401 changes its orientation between a landscape orientation and another landscape orientation or between a portrait orientation and another portrait orientation.

The landscape-portrait reorientation may entail a plurality of regions, and the processor 490 may determine which one of the plurality of regions the electronic device 401 belongs to based on the detected attitude angle of the electronic device 401.

The plurality of landscape-portrait reorientation regions may include a first landscape-portrait reorientation region D1 between the first landscape orientation (e.g., x axis=0°) and the first portrait orientation (e.g., x axis=90°), a second landscape-portrait reorientation region D2 between the first portrait orientation (e.g., x axis=90°) and the second landscape orientation (e.g., x axis=180°), a third landscape-portrait reorientation region D3 between the second landscape orientation (e.g., x axis=180°) and the second portrait orientation (e.g., x axis=270°), and a fourth landscape-portrait reorientation region D4 between the second portrait orientation (e.g., x axis=270°) and the first landscape orientation (e.g., x axis=360° (=0°)).

The first landscape-portrait reorientation region D1 may be a region (e.g., 30° to 60°) between a first attitude angle d11 and a second attitude angle d12, the second landscape-portrait reorientation region D2 may be a region (e.g., about 120° to about 150°) between a third attitude angle d21 and a fourth attitude angle d22, the third landscape-portrait reorientation region D3 may be a region (e.g., 210° to 240°) between a fifth attitude angle d31 and a sixth attitude angle d32, and the fourth landscape-portrait reorientation region D4 may be a region (e.g., about 300° to about 330°) between a seventh attitude angle d41 and an eighth attitude angle d42. For example, based on at least part of the detected orientation or position of the electronic device 401, the processor 490 may determine that the electronic device 401 is in the first landscape-portrait reorientation region D1 when the attitude angle (e.g., x axis=45°) of the electronic device 401 falls within the region between the first attitude angle d11 and the second attitude angle d12, that the electronic device 401 is in the second landscape-portrait reorientation region D2 when the attitude angle (e.g., x axis=135°) of the electronic device 401 falls within the region between the third attitude angle d21 and the fourth attitude angle d22, that the electronic device 401 is in the third landscape-portrait reorientation region D3 when the attitude angle (e.g., x axis=225°) of the electronic device 401 falls within the region between the fifth attitude angle d31 and the sixth attitude angle d32, and that the electronic device 401 is in the fourth landscape-portrait reorientation region D4 when the attitude angle (e.g., x axis=315°) of the electronic device 401 falls within the region between the seventh attitude angle d41 and the eighth attitude angle d42.

Upon determining that the orientation or position of the electronic device 401 is changed in the landscape-portrait reorientation region based on the results of determination, the processor 490 may keep outputting at least some frequency components of the first channel audio data and the second channel audio data via the first speaker 410 and the second speaker 420 while switching between the first speaker 410 and the second speaker 420 for the remaining frequency components.

Upon determining that the attitude angle of the electronic device 401 falls in the first or third landscape-portrait reorientation region D1 or D3, the processor 490 may keep outputting the first frequency component of the first channel audio data and the second frequency component of the second channel audio data via the first speaker 410 and the second speaker 420 while switching the second frequency component of the first channel audio data and the first frequency component of the second channel audio data.

Upon determining that the attitude angle of the electronic device 401 falls in the second or fourth landscape-portrait reorientation region D2 or D4, the processor 490 may keep outputting the second frequency component of the first channel audio data and the first frequency component of the second channel audio data via the first speaker 410 and the second speaker 420 while switching the first frequency component of the first channel audio data and the second frequency component of the second channel audio data.

Playing audio data based on the determined landscape-portrait orientation range (e.g., D1 to D4) is described below in greater detail with reference to FIGS. 4B and 4C.

Upon determining that the orientation or position of the electronic device 401 is changed in the landscape-landscape reorientation or portrait-portrait reorientation based on the results of determination, the processor 490 may keep playing or outputting at least some frequency components of the first channel audio data and the second channel audio data via the first speaker 410 and the second speaker 420 while switching between the first speaker 410 and the second speaker 420 for the remaining frequency components.

When the calculated variation in attitude angle is not less than the threshold, and the prior orientation or position of the electronic device 401 recognized or detected is a landscape orientation (e.g., the first landscape orientation (x axis=0°) or the second landscape orientation (x axis=180°)), the processor 490 may determine that the electronic device 401 has changed its orientation or position in the landscape-landscape reorientation.

Upon determining that the electronic device 401 has performed portrait-portrait reorientation, the processor 490 may switch the second frequency component of the first channel audio data and the second frequency component of the second channel audio data which have been crossed-over and which are being played via the first speaker 410 to the second speaker 420. Simultaneously, the processor 490 may switch the first frequency component of the first channel audio data and the first frequency component of the second channel audio data which have been crossed-over and which are being played via the second speaker 420 to the first speaker 410.

When the calculated variation in attitude angle is not less than the threshold, and the prior orientation or position of the electronic device 401 recognized or detected is a portrait orientation (e.g., the first portrait orientation (x axis=90°) or the second portrait orientation (x axis=270°)), the processor 490 may determine that the electronic device 401 has changed its orientation or position in the landscape-landscape reorientation.

Upon determining that the electronic device 401 has performed landscape-landscape reorientation, the processor 490 may switch the first frequency component of the first channel audio data and the second frequency component of the first channel audio data which are being played via the first speaker 410 to the second speaker 420. Simultaneously, the processor 490 may switch the first frequency component of the second channel audio data and the second frequency component of the second channel audio data which are being played via the second speaker 420 to the first speaker 410.

Referring to FIG. 4B, when the electronic device 401 is in the first landscape orientation (+x axis=0°), the processor 490 may play the first channel audio data via the first speaker 410 and the second channel audio data via the second speaker 420. Upon determining that the electronic device 401 makes a landscape-portrait reorientation based on at least part of the orientation or position of the electronic device 401 while playing the first channel audio data and the second channel audio data in the first landscape orientation (+x axis=0°), the processor 490 may determine to which one of the plurality of landscape-portrait regions the electronic device 401 belongs.

When the determined landscape-portrait reorientation range is the first landscape-portrait reorientation range D1 based on at least part (e.g., the attitude angle (e.g., +x axis=45°)) of the orientation or position of the electronic device 401, the processor 490 may keep outputting the first frequency component of the first channel audio data and the second frequency component of the second channel audio data via the first speaker 410 and the second speaker 420 while switching the second frequency component of the first channel audio data and the first frequency component of the second channel audio data. Thus, the processor 490 may keep outputting some frequency components of the first channel audio data and the second channel audio data in the first landscape-portrait reorientation range D1 while crossing over the remaining frequency components, thereby enabling the seamless playing of audio data.

In the determined first landscape-portrait reorientation range D1, while outputting the first frequency component of the first channel audio data via the first speaker 410 and the second frequency component of the second channel audio data via the second speaker 420, the processor 490 may stop outputting the second frequency component of the first channel audio data via the first speaker 410 and output the first frequency component of the second channel audio data, which has been switched from the second speaker 420, via the first speaker 410, and the processor 490 may stop outputting the first frequency component of the second channel audio data via the second speaker 420 and output the second frequency component of the first channel audio data, which has been switched from the first speaker 410, via the second speaker 420.

In the determined first landscape-portrait reorientation range D1, while outputting the first frequency component of the first channel audio data via the first speaker 410 and the second frequency component of the second channel audio data via the second speaker 420, the processor 490 may fade-out the second frequency component of the first channel audio data output via the first speaker 410 and fade-in the first frequency component of the second channel audio data, which has been switched from the second speaker 420, and output it via the first speaker 410, and the processor 490 may fade-out the first frequency component of the second channel audio data output via the second speaker 420 and fade-in the second frequency component of the first channel audio data, which has been switched from the first speaker 410, and output it via the second speaker 420.

When the reorientation of the electronic device 401 from the first landscape orientation (x axis=0°) to the first portrait orientation (x axis=90°) is complete, the processor 490 may, in the first portrait orientation (x axis=90°), play the first frequency component of the first channel audio data and the first frequency component of the second channel audio data via the first speaker 410 and the second frequency component of the first channel audio data and the second frequency component of the second channel audio data via the second speaker 420. Upon determining that the electronic device 401 makes the landscape-portrait reorientation based on at least part of the orientation or position of the electronic device 401 while playing audio data resulting from a cross-over of some frequency components of the first channel audio data and the second channel audio data via the first speaker 410 and the second speaker 420 in the first portrait orientation (+x axis=90°), the processor 490 may determine to which one of the plurality of landscape-portrait regions the electronic device 401 belongs.

When the determined landscape-portrait reorientation range is the second landscape-portrait reorientation range D2 based on at least part (e.g., the attitude angle (e.g., +x axis=135°)) of the orientation or position of the electronic device 401, the processor 490 may keep outputting the second frequency component of the first channel audio data and the first frequency component of the second channel audio data via the first speaker 410 and the second speaker 420 while switching the first frequency component of the first channel audio data and the second frequency component of the second channel audio data. Thus, the processor 490 may keep outputting some frequency components of the first channel audio data and the second channel audio data in the second landscape-portrait reorientation range D2 while crossing over the remaining frequency components, thereby enabling the seamless playing of audio data.

In the determined second landscape-portrait reorientation range D2, while outputting the first frequency component of the second channel audio data via the first speaker 410 and the second frequency component of the first channel audio data via the second speaker 420, the processor 490 may stop outputting the first frequency component of the first channel audio data via the first speaker 410 and output the second frequency component of the second channel audio data, which has been switched from the second speaker 420, via the first speaker 410, and the processor 490 may stop outputting the second frequency component of the second channel audio data via the second speaker 420 and output the first frequency component of the first channel audio data, which has been switched from the first speaker 410, via the second speaker 420.

In the determined second landscape-portrait reorientation range D2, while outputting the first frequency component of the second channel audio data via the first speaker 410 and the second frequency component of the first channel audio data via the second speaker 420, the processor 490 may fade-out the first frequency component of the first channel audio data output via the first speaker 410 and fade-in the second frequency component of the second channel audio data, which has been switched from the second speaker 420, and output it via the first speaker 410, and the processor 490 may fade-out the second frequency component of the second channel audio data output via the second speaker 420 and fade-in the first frequency component of the first channel audio data, which has been switched from the first speaker 410, and output it via the second speaker 420.

When the reorientation of the electronic device 401 from the second portrait orientation (x axis=90°) to the second landscape orientation (x axis=180°) is complete, the processor 490 may, in the second landscape orientation (x axis=180°), play the first frequency component of the second channel audio data and the second frequency component of the second channel audio data via the first speaker 410 and the first frequency component of the first channel audio data and the second frequency component of the first channel audio data via the second speaker 420. Upon determining that the electronic device 401 makes the landscape-portrait reorientation based on at least part of the orientation or position of the electronic device 401 while playing audio data resulting from a channel switch of the frequency components of the first channel audio data and the second channel audio data via the first speaker 410 and the second speaker 420 in the second landscape orientation (x axis=180°), the processor 490 may determine to which one of the plurality of landscape-portrait regions the electronic device 401 belongs.

Referring to FIG. 4C, when the determined landscape-portrait reorientation range is the third landscape-portrait reorientation range D3 based on at least part (e.g., the attitude angle (e.g., +x axis=225°)) of the orientation or position of the electronic device 401, the processor 490 may keep outputting the first frequency component of the first channel audio data and the second frequency component of the second channel audio data via the first speaker 410 and the second speaker 420 while switching the second frequency component of the first channel audio data and the first frequency component of the second channel audio data. Thus, the processor 490 may keep outputting some frequency components of the first channel audio data and the second channel audio data in the third landscape-portrait reorientation range D3 while crossing over the remaining frequency components, thereby enabling the seamless playing of audio data.

In the determined third landscape-portrait reorientation range D3, while outputting the second frequency component of the second channel audio data via the first speaker 410 and the first frequency component of the first channel audio data via the second speaker 420, the processor 490 may stop outputting the first frequency component of the second channel audio data via the first speaker 410 and output the second frequency component of the first channel audio data, which has been switched from the second speaker 420, via the first speaker 410, and the processor 490 may stop outputting the second frequency component of the first channel audio data via the second speaker 420 and output the first frequency component of the second channel audio data, which has been switched from the first speaker 410, via the second speaker 420.

In the determined third landscape-portrait reorientation range D3, while outputting the second frequency component of the second channel audio data via the first speaker 410 and the first frequency component of the first channel audio data via the second speaker 420, the processor 490 may fade-out the first frequency component of the second channel audio data output via the first speaker 410 and fade-in the second frequency component of the first channel audio data, which has been switched from the second speaker 420, and output it via the first speaker 410, and the processor 490 may fade-out the second frequency component of the first channel audio data output via the second speaker 420 and fade-in the first frequency component of the second channel audio data, which has been switched from the first speaker 410, and output it via the second speaker 420.

When the reorientation of the electronic device 401 from the second landscape orientation (x axis=180°) to the second portrait orientation (x axis=270°) is complete, the processor 490 may, in the second portrait orientation (x axis=270°), play the second frequency component of the first channel audio data and the second frequency component of the second channel audio data via the first speaker 410 and the first frequency component of the first channel audio data and the first frequency component of the second channel audio data via the second speaker 420. Upon determining that the electronic device 401 makes the landscape-portrait reorientation based on at least part of the orientation or position of the electronic device 401 while playing audio data resulting from a crossover of some frequency components of the first channel audio data and the second channel audio data via the first speaker 410 and the second speaker 420 in the second portrait orientation (x axis=270°), the processor 490 may determine to which one of the plurality of landscape-portrait regions the electronic device 401 belongs.

When the determined landscape-portrait reorientation range is the fourth landscape-portrait reorientation range D4 based on at least part (e.g., the attitude angle (e.g., +x axis=325°)) of the orientation or position of the electronic device 401, the processor 490 may keep outputting the second frequency component of the first channel audio data and the first frequency component of the second channel audio data via the first speaker 410 and the second speaker 420 while switching the first frequency component of the first channel audio data and the second frequency component of the second channel audio data. Thus, the processor 490 may keep outputting some frequency components of the first channel audio data and the second channel audio data in the fourth landscape-portrait reorientation range D4 while crossing over the remaining frequency components, thereby enabling the seamless playing of audio data.

In the determined fourth landscape-portrait reorientation range D4, while outputting the second frequency component of the first channel audio data via the first speaker 410 and the first frequency component of the second channel audio data via the second speaker 420, the processor 490 may stop outputting the second frequency component of the second channel audio data via the first speaker 410 and output the first frequency component of the first channel audio data, which has been switched from the second speaker 420, via the first speaker 410, and the processor 490 may stop outputting the first frequency component of the first channel audio data via the second speaker 420 and output the second frequency component of the second channel audio data, which has been switched from the first speaker 410, via the second speaker 420.

In the determined fourth landscape-portrait reorientation range D4, while outputting the second frequency component of the first channel audio data via the first speaker 410 and the first frequency component of the second channel audio data via the second speaker 420, the processor 490 may fade-out the second frequency component of the second channel audio data output via the first speaker 410 and fade-in the first frequency component of the first channel audio data, which has been switched from the second speaker 420, and output it via the first speaker 410, and the processor 490 may fade-out the first frequency component of the first channel audio data output via the second speaker 420 and fade-in the second frequency component of the second channel audio data, which has been switched from the first speaker 410, and output it via the second speaker 420.

When the reorientation of the electronic device 401 from the second portrait orientation (x axis=270°) to the first landscape orientation (x axis=360° (=0°)) is complete, the processor 490 may, in the first landscape orientation (x axis=360° (=0°)), play the first frequency component of the first channel audio data and the second frequency component of the first channel audio data via the first speaker 410 and the first frequency component of the second channel audio data and the second frequency component of the second channel audio data via the second speaker 420. The processor 490 may play the original first and second channel audio data via the first and second speakers 410 and 420 in the first landscape orientation (x axis=360° (=0°)).

Although in the above-described embodiments the electronic device 401 changes orientation between landscape and portrait in the order of the first landscape orientation (x axis=0°), the first portrait orientation (x axis=90°), the second landscape orientation (x axis=180°), the second portrait orientation (x axis=90°), and the first landscape orientation (x axis=360°=0°), the present disclosure is not limited thereto, and the present disclosure may also be applicable to the opposite case referring to FIGS. 4B and 4C.

Figure 5:
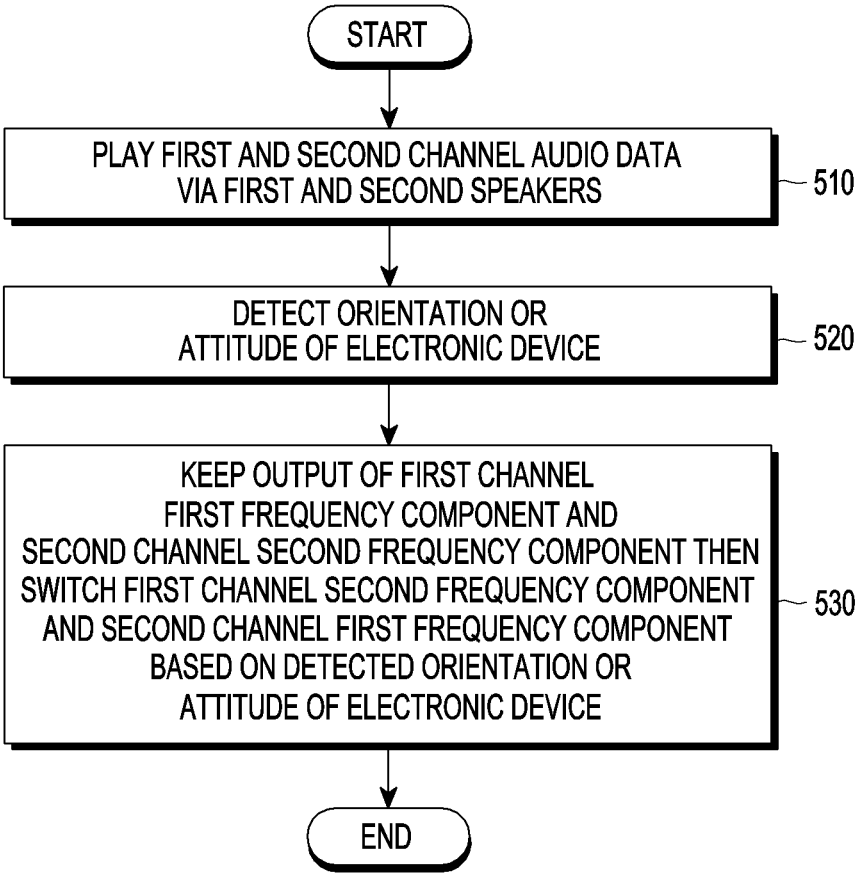
FIG. 5 is a flowchart of a method for playing audio using a dual speaker of an electronic device according to an embodiment.

FIG. 5 is a flowchart of a method for playing audio using a dual speaker of an electronic device according to an embodiment. The method may be performed by at least one of an electronic device 401 or a processor 490, or the audio processor 477 of the electronic device.

Referring to FIG. 5, in step 510, the electronic device may play first channel audio data and second channel audio data via a first speaker 410 and a second speaker 420.

The first speaker may be a first channel speaker (e.g., a left-hand speaker) corresponding to a first channel, and the second speaker may be a second channel speaker (e.g., a right-hand speaker) corresponding to a second channel.

The first channel audio data may include a first frequency component and a second frequency component, and the second channel audio data may include a first frequency component and a second frequency component. The first frequency components may be high-tone (or high frequency) components of the channel audio data, and the second frequency components may be low-tone (or low frequency) components of the channel audio data.

In step 520, the electronic device may detect an orientation or attitude of the electronic device while playing the first channel audio data and the second channel audio data.

The electronic device may detect the variation in the orientation or attitude of the electronic device via a sensor 440 while playing the first channel audio data and the second channel audio data.

The electronic device may yield or detect the rotation angle (e.g., the pitch angle, roll angle, or yaw angle) of each axis (e.g., the x axis, y axis, or z axis) of the electronic device obtained based on sensing values detected via the sensor. The electronic device may recognize or detect the orientation or attitude of the electronic device based on the rotation angle, assumed azimuth, or attitude angle detected from the sensor.

The sensor may include a geo-magnetic sensor or a gyro sensor.

In step 530, based on at least part of the detected orientation or attitude of the electronic device, the electronic device may keep outputting the first frequency component of the first channel audio data and the second frequency component of the second channel audio data via the first speaker and the second speaker while switching the second frequency component of the first channel audio data and the first frequency component of the second channel audio data.

Based on at least part of the orientation or attitude of the electronic device, while outputting the first frequency component of the first channel audio data via the first speaker and the second frequency component of the second channel audio data via the second speaker, the electronic device may stop outputting the second frequency component of the first channel audio data via the first speaker and output the first frequency component of the second channel audio data, which has been switched from the second speaker, via the first speaker. Simultaneously, the electronic device may stop outputting the first frequency component of the second channel audio data via the second speaker and output the second frequency component of the first channel audio data, which has been switched from the first speaker, via the second speaker.

Based on at least part of the orientation or attitude of the electronic device, while outputting the first frequency component of the first channel audio data via the first speaker and the second frequency component of the second channel audio data via the second speaker, the electronic device may fade-out the second frequency component of the first channel audio data output via the first speaker and fade-in the first frequency component of the second channel audio data, which has been switched from the second speaker, and output it via the first speaker. Simultaneously, the electronic device may fade-out outputting the first frequency component of the second channel audio data output via the second speaker and fade-in the second frequency component of the first channel audio data, which has been switched from the first speaker, and output it via the second speaker.

Figure 6:
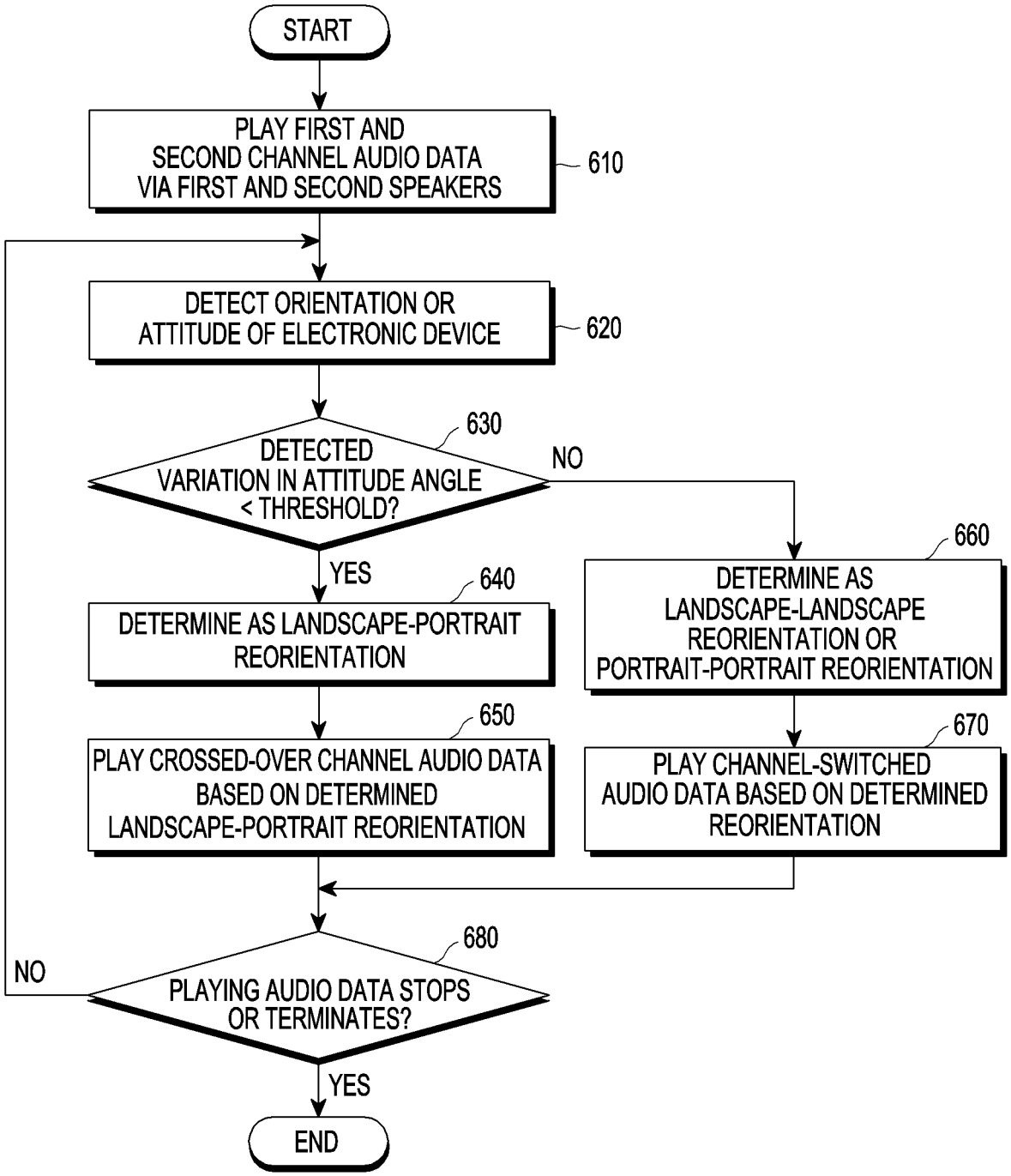
FIG. 6 is a flowchart of a method for playing audio using a dual speaker of an electronic device according to an embodiment.

FIG. 6 is a flowchart of a method for playing audio using a dual speaker of an electronic device according to an embodiment. The method may be performed by at least one of an electronic device 401 or a processor 490, or the audio processor 477 of the electronic device.

Referring to FIG. 6, in step 610, the electronic device may play first channel audio data and second channel audio data via a first speaker 410 and a second speaker 420. Step 610 is the same as step 510 of FIG. 5, thus, no description thereof is given below.

In step 620, the electronic device may detect its orientation or attitude while playing the first channel audio data and the second channel audio data via the first speaker and the second speaker. Step 620 may be at least partially the same as step 520 of FIG. 5.

In step 630, the electronic device may determine whether the variation in the attitude angle of the electronic device is less than a threshold based on at least part of the detected orientation or attitude of the electronic device. In step 630, the electronic device may perform step 640 when the variation in attitude angle is less than the threshold and perform step 660 when the variation in attitude angle is not less than the threshold.

The attitude angle of the electronic device may be a horizontal angle at which the electronic device rotates clockwise from a first axis (e.g., +x axis=0°) of the electronic device corresponding to a landscape orientation of the electronic device. The attitude angle may range from 0° to 360°. For example, the orientation or attitude of the electronic device when the first axis is at 0° may be a first landscape orientation, the orientation or attitude when the first axis is at 90° may be a first portrait orientation, the orientation or attitude when the first axis is at 180° may be a second landscape orientation, and the orientation or attitude when the first axis is at 270° may be a second portrait orientation.

When the electronic device varies its orientation or attitude, the electronic device may calculate the variation in the orientation or attitude of the electronic device based on at least part of the current orientation or attitude, recognized or detected, of the electronic device. For example, the electronic device may calculate the variation in the attitude angle of the electronic device. The variation in the attitude angle of the electronic device may be the difference between the current attitude angle of the electronic device recognized or detected and the prior attitude angle of the electronic device recognized or detected.

For example, the electronic device may compare the variation in the attitude angle of the electronic device with a threshold. For example, the electronic device may determine whether the variation in the attitude angle of the electronic device is less than the threshold. The electronic device may determine whether the electronic device changes its orientation or attitude between a landscape orientation and a portrait orientation, between a landscape orientation and another landscape orientation, or between a portrait orientation and another portrait orientation based on the results of the comparison.

In step 640, when the variation in the attitude angle of the electronic device is less than the threshold, the electronic device may determine that the electronic device changes its orientation or attitude between a landscape orientation and a portrait orientation. For example, the electronic device may calculate the variation in attitude angle based on at least part of the detected orientation or attitude of the electronic device. When the calculated variation in attitude angle is less than the threshold, the electronic device may determine that the electronic device changes its orientation or attitude between a landscape orientation and a portrait orientation.

The threshold may range from about 130° to 140°. For example, when the threshold is set to 135°, and the calculated variation in attitude angle is less than 135°, the electronic device may determine that the electronic device changes its orientation between a landscape orientation and a portrait orientation.

The landscape-portrait reorientation may entail a plurality of regions, and the electronic device may determine which one of the plurality of regions the electronic device 401 belongs to based on the detected attitude angle.

The plurality of landscape-portrait reorientation regions may include a first landscape-portrait reorientation region D1 between the first landscape orientation (e.g., x axis=0°) and the first portrait orientation (e.g., x axis=90°), a second landscape-portrait reorientation region D2 between the first portrait orientation (e.g., x axis=90°) and the second landscape orientation (e.g., x axis=180°), a third landscape-portrait reorientation region D3 between the second landscape orientation (e.g., x axis=180°) and the second portrait orientation (e.g., x axis=270°), and a fourth landscape-portrait reorientation region D4 between the second portrait orientation (e.g., x axis=270°) and the first landscape orientation (e.g., x axis=360° (360°=0°)).

The first landscape-portrait reorientation region D1 may be a region (e.g., 30° to 60°) between a first attitude angle d11 and a second attitude angle d12, the second landscape-portrait reorientation region D2 may be a region (e.g., about 120° to about 150°) between a third attitude angle d21 and a fourth attitude angle d22, the third landscape-portrait reorientation region D3 may be a region (e.g., 210° to 240°) between a fifth attitude angle d31 and a sixth attitude angle d32, and the fourth landscape-portrait reorientation region D4 may be a region (e.g., about 300° to about 330°) between a seventh attitude angle d41 and an eighth attitude angle d42.

For example, based on at least part of the detected orientation or attitude of the electronic device, the electronic device may determine that the electronic device is in the first landscape-portrait reorientation region D1 when the attitude angle (e.g., x axis=45°) of the electronic device falls within the region between the first attitude angle d11 and the second attitude angle d12, that the electronic device is in the second landscape-portrait reorientation region D2 when the attitude angle (e.g., x axis=135°) of the electronic device falls within the region between the third attitude angle d21 and the fourth attitude angle d22, that the electronic device is in the third landscape-portrait reorientation region D3 when the attitude angle (e.g., x axis=225°) of the electronic device falls within the region between the fifth attitude angle d31 and the sixth attitude angle d32, and that the electronic device 401 is in the fourth landscape-portrait reorientation region D4 when the attitude angle (e.g., x axis=315°) of the electronic device 401 falls within the region between the seventh attitude angle d41 and the eighth attitude angle d42.

In step 650, the electronic device may play channel audio data resulting from at least partially crossing over the first channel audio data and the second channel audio data via the first speaker and second speaker based on the determined landscape-portrait reorientation. A method for playing the crossed-over channel audio data in step 650 is described below in greater detail with reference to FIGS. 7 to 10.

In step 660, when the variation in attitude angle is not less than the threshold, the electronic device may determine that the electronic device changes its attitude angle between a landscape orientation and another landscape orientation or between a portrait orientation and another portrait orientation. When the calculated variation in attitude angle is not less than the threshold, the electronic device may determine that the electronic device changes its orientation between a landscape orientation and another landscape orientation or between a portrait orientation and another portrait orientation, indicating that the electronic device is left-right inverted. For example, when the threshold is set to 135°, and the calculated variation in attitude angle is not less than 135°, the electronic device may determine that the electronic device changes its orientation between a landscape orientation and another landscape orientation or between a portrait orientation and another portrait orientation.

When the calculated variation in attitude angle is not less than the threshold, and the prior orientation or attitude of the electronic device recognized or detected is a landscape orientation (e.g., the first landscape orientation (x axis=0°) or the second landscape orientation (x axis=180°)), the electronic device may determine that the electronic device changes its orientation or attitude between a landscape orientation and another landscape orientation.

The landscape-landscape reorientation may be a reorientation from the first landscape orientation (x axis=0°) to the second landscape orientation (x axis=180°). Conversely, the landscape-landscape reorientation may be a reorientation from the second landscape orientation (x axis=180°) to the first landscape orientation (x axis=0°).

When the calculated variation in attitude angle is not less than the threshold, and the prior orientation or attitude of the electronic device recognized or detected is a portrait orientation (e.g., the first portrait orientation (x axis=90°) or the second portrait orientation (x axis=270°)), the electronic device may determine that the electronic device changes its orientation or attitude between a portrait orientation and another portrait orientation.

The portrait-portrait reorientation may be a reorientation from the first portrait orientation (x axis=90°) to the second portrait orientation (x axis=270°). Conversely, the portrait-portrait reorientation may be a reorientation from the second portrait orientation (x axis=270°) to the first portrait orientation (x axis=90°).

In step 670, the electronic device may play the first channel audio data and the second channel audio data, which have had their channels switched, via the first speaker and the second speaker based on the determined landscape-landscape reorientation or portrait-portrait reorientation range. A method for playing the channel-switched channel audio data in step 670 is described below in greater detail with reference to FIGS. 11 and 12.

In step 680, the electronic device may determine whether playing the audio data via the first speaker and the second speaker is stopped or terminated.

For example, while playing the first channel audio data and the second channel audio data via the first speaker and second speaker, while playing the crossed-over audio data of the first channel audio data and the second channel audio data via the first speaker and the second speaker based on a landscape-portrait reorientation of the electronic device, or while playing the channel-switched audio data based on a landscape-landscape reorientation or portrait-portrait reorientation of the electronic device, the electronic device may determine whether there is a signal input to stop or terminate the playing of audio data.

When there is no signal input to stop or terminate playing the audio data via the first speaker and the second speaker in step 680, the electronic device may perform step 620, and when there is a signal input to stop or terminate playing the audio data in step 680, the electronic device may stop or terminate the playing of audio data.

Figure 7:
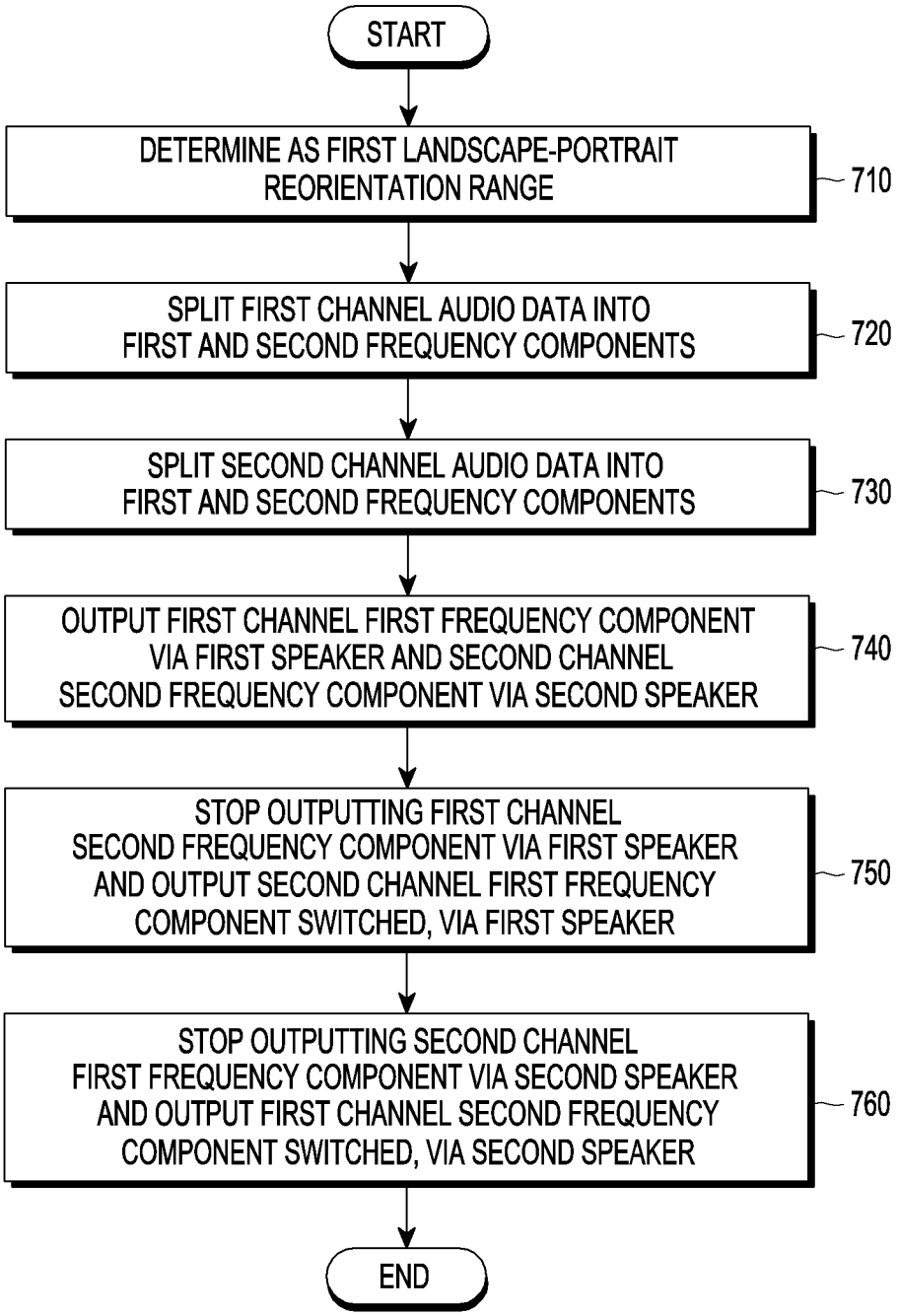
FIG. 7 is a flowchart of a method for playing audio on an electronic device according to an embodiment.

FIG. 7 is a flowchart of a method for playing audio using a dual speaker of an electronic device according to an embodiment. FIG. 7 is a flowchart of a method for playing crossed-over channel audio data according to step 650 as shown in FIG. 6. The method may be performed by at least one of an electronic device 401 or a processor 490, or the audio processor 477 of the electronic device.

Referring to FIG. 7, in step 710, the electronic device may determine that the attitude angle of the electronic device is in the first landscape-portrait reorientation range D1. Step 710 may be at least partially the same as step 640 of FIG. 6.

In step 720, the electronic device may split the first channel audio data into a first frequency component and a second frequency component. For example, the electronic device may split the first channel audio data into the first frequency component and the second frequency component using a first splitter 471 and a second splitter 473.

The electronic device may split the first frequency component off from the first channel audio data using the first splitter and the second frequency component off from the first channel audio data using the second splitter.

The first frequency component may be a high-tone (or high frequency) component of the first channel audio data, and the second frequency component may be a low-tone (or low frequency) component of the first channel audio data. The first splitter may be an HPF, and the second splitter may be an LPF.

In step 730, the electronic device may split the second channel audio data into a first frequency component and a second frequency component. For example, the electronic device may split the second channel audio data into the first frequency component and the second frequency component using a first splitter and a second splitter.

The electronic device may split the first frequency component off from the first channel audio data using the first splitter and the second frequency component off from the first channel audio data using the second splitter.

The first frequency component may be a high-tone (or high frequency) component of the first channel audio data, and the second frequency component may be a low-tone (or low frequency) component of the first channel audio data.

Although examples of splitting each of the first channel audio data and the second channel audio data into the first and second frequency components in steps 720 and 730 have been described above, embodiments of the present disclosure are not limited thereto. For example, each of the first channel audio data and the second channel audio data may be replicated, and the replica of each of the first channel audio data and the second channel audio data may be split into a first frequency component and a second frequency component. Alternatively, the first channel audio data and the second channel audio data may be provided with each already split into the first and second frequency components, or each channel audio data may be split into the first and second frequency components before step 640 of FIG. 6. In such a case, steps 720 and 730 may be omitted.

In step 740, the electronic device may output the first frequency component of the first channel audio data via the first speaker and the second frequency component of the second channel audio data via the second speaker.

In step 750, while continuing to output the first frequency component of the first channel audio data and the second frequency component of the second channel audio data via the first and second speakers in step 740, the electronic device may stop outputting the second frequency component of the first channel audio data via the first speaker and output the first frequency component of the second channel audio data, which has been switched from the second speaker, via the first speaker.

Stopping the output of the second frequency component of the first channel audio data via the first speaker may include fading out the second frequency component of the first channel audio data which is being played via the first speaker.

Outputting, via the first speaker, the first frequency component of the second channel audio data, which has been switched from the second speaker may include fading in and outputting, via the first speaker, the first frequency component of the second channel audio data, which has been switched from the second speaker.

In step 760, the electronic device may stop outputting the first frequency component of the second channel audio data via the second speaker and output the second frequency component of the first channel audio data, which has been switched from the first speaker, via the second speaker.

Stopping the output of the first frequency component of the second channel audio data via the second speaker may include fading out the second frequency component of the first channel audio data which is being played via the second speaker.

Outputting, via the second speaker, the second frequency component of the first channel audio data, which has been switched from the first speaker may include fading in and outputting, via the second speaker, the first frequency component of the second channel audio data, which has been switched from the first speaker.

According to an embodiment, the electronic device may simultaneously perform steps 740 to 760.

Figure 8:
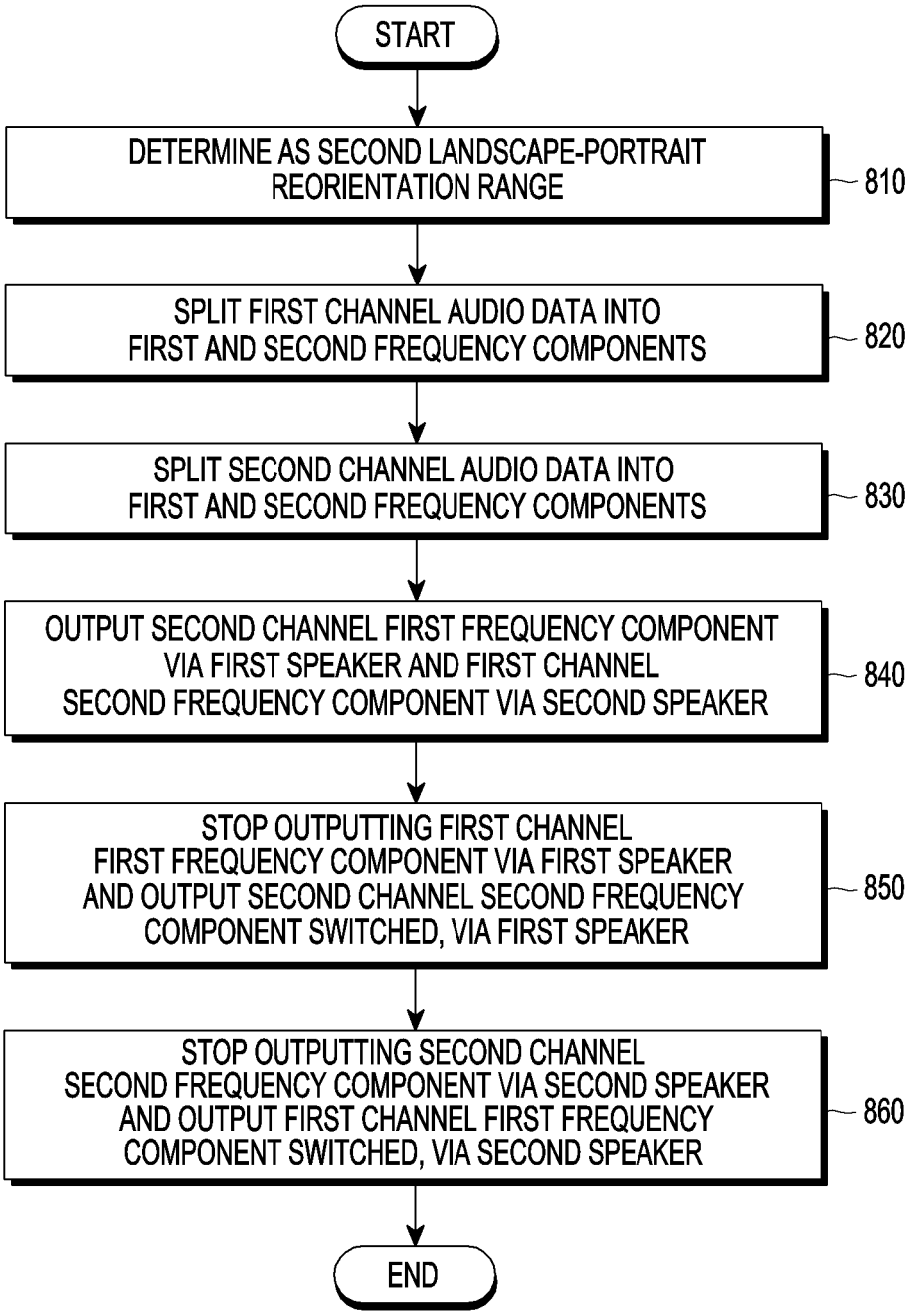
FIG. 8 is a flowchart of a method for playing audio on an electronic device according to an embodiment.

FIG. 8 is a flowchart of a method for playing audio using a dual speaker of an electronic device according to an embodiment. FIG. 8 is a flowchart of a method for playing crossed-over channel audio data according to step 650 as shown in FIG. 6. The method may be performed by at least one of an electronic device 401 or a processor 90, or the audio processor 477 of the electronic device.

Referring to FIG. 8, in step 810, the electronic device may determine that the attitude angle of the electronic device is in the second landscape-portrait reorientation range. Step 810 may be at least partially the same as step 640 of FIG. 6, and no detailed description thereof is thus given.

In step 820, the electronic device may split the first channel audio data into a first frequency component and a second frequency component.

In step 830, the electronic device may split the second channel audio data into a first frequency component and a second frequency component. Steps 820 and 830 may be the same as steps 720 and 730 of FIG. 7 described above, thus, no detailed description thereof is given below.

In step 840, the electronic device may output the first frequency component of the second channel audio data via the first speaker and the second frequency component of the first channel audio data via the second speaker.

In step 850, while continuing to output the first frequency component of the second channel audio data and the second frequency component of the first channel audio data via the first speaker and the second speaker in step 840, the electronic device may stop outputting the first frequency component of the first channel audio data via the first speaker and output the second frequency component of the second channel audio data, which has been switched from the second speaker, via the first speaker.

Stopping the output of the first frequency component of the first channel audio data via the first speaker may include fading out the first frequency component of the first channel audio data which is being played via the first speaker.

Outputting, via the first speaker, the second frequency component of the second channel audio data, which has been switched from the second speaker may include fading in and outputting, via the second speaker, the second frequency component of the second channel audio data, which has been switched from the second speaker.

In step 860, the electronic device may stop outputting the second frequency component of the second channel audio data via the second speaker and output the first frequency component of the first channel audio data, which has been switched from the first speaker, via the second speaker.

Stopping the output of the second frequency component of the second channel audio data via the second speaker may include fading out the second frequency component of the second channel audio data which is being played via the second speaker.

Outputting, via the second speaker, the first frequency component of the first channel audio data, which has been switched from the first speaker may include fading in and outputting, via the second speaker, the first frequency component of the first channel audio data, which has been switched from the first speaker.

According to an embodiment, the electronic device may simultaneously perform steps 840 to 860.

Figure 9:
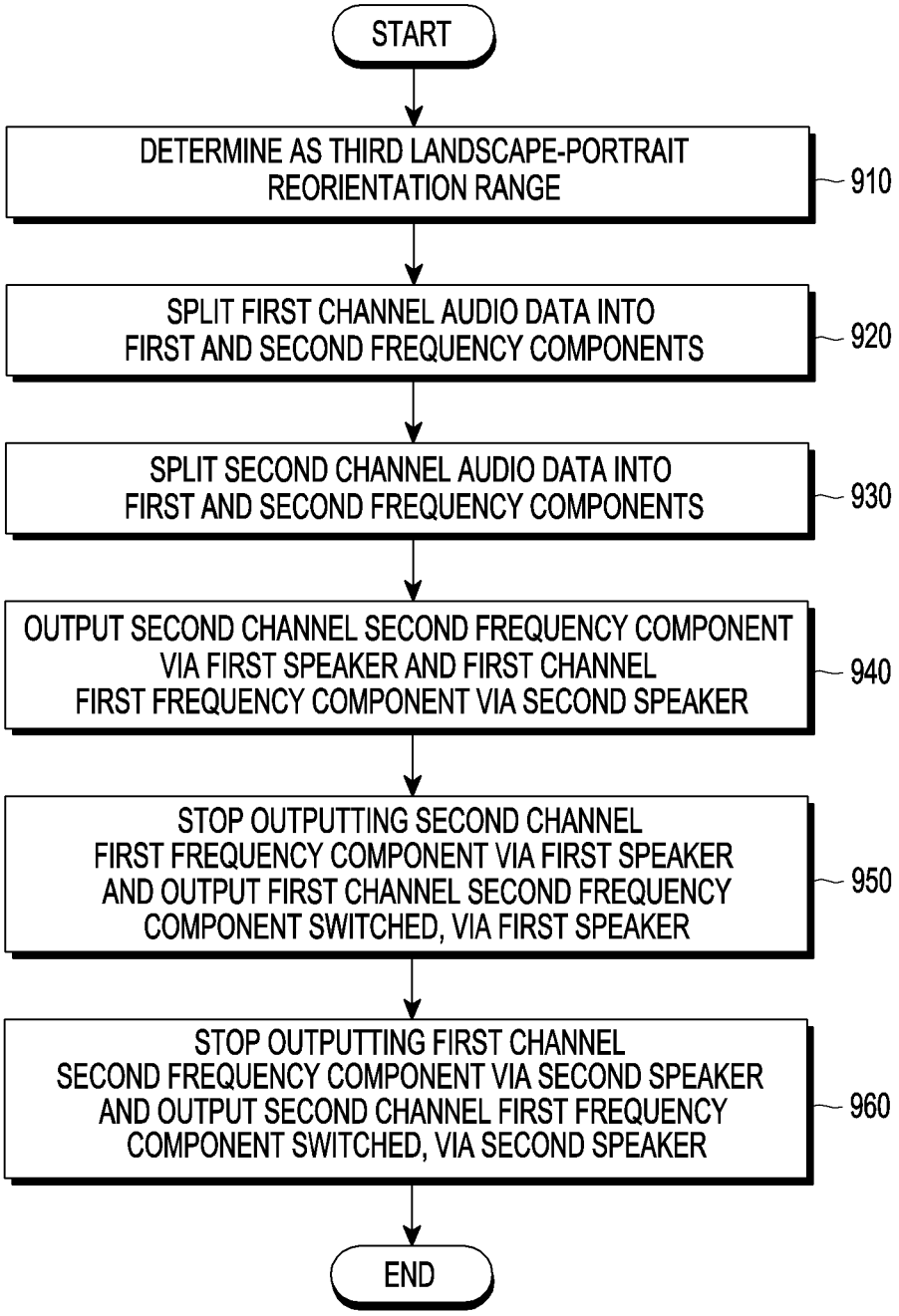
FIG. 9 is a flowchart of a method for playing audio on an electronic device according to an embodiment.

FIG. 9 is a flowchart of a method for playing audio using a dual speaker of an electronic device according to an embodiment. FIG. 9 is a flowchart of a method for playing crossed-over channel audio data according to step 650 as shown in FIG. 6. The method may be performed by at least one of an electronic device 401 or a processor 490, or the audio processor 477 of the electronic device.

Referring to FIG. 9, in step 910, the electronic device may determine that the attitude angle of the electronic device is in the third landscape-portrait reorientation range. Step 910 may be at least partially the same as step 640 of FIG. 6 described above, thus, no detailed description thereof is given below.

In step 920, the electronic device may split the first channel audio data into a first frequency component and a second frequency component.

In step 930, the electronic device may split the second channel audio data into a first frequency component and a second frequency component. Steps 920 and 930 may be the same as steps 720 and 730 of FIG. 7 described above, thus, no detailed description thereof is given below.

In step 940, the electronic device may output the second frequency component of the second channel audio data via the first speaker and the first frequency component of the first channel audio data via the second speaker.

In step 950, while continuing to output the second frequency component of the second channel audio data and the first frequency component of the first channel audio data via the first and second speakers in step 940, the electronic device may stop outputting the first frequency component of the second channel audio data via the first speaker and output the second frequency component of the first channel audio data, which has been switched from the second speaker, via the first speaker.

Outputting the first frequency component of the second channel audio via the first speaker may include fading out the first frequency component of the second channel audio data which is being played via the first speaker.

Outputting, via the first speaker, the second frequency component of the first channel audio data, which has been switched from the second speaker may include fading in and outputting, via the first speaker, the second frequency component of the first channel audio data, which has been switched from the second speaker.

In step 960, the electronic device may stop outputting the second frequency component of the first channel audio data via the second speaker and output the first frequency component of the second channel audio data, which has been switched from the first speaker, via the second speaker.

Stopping the output of the second frequency component of the first channel audio data via the second speaker may include fading out the second frequency component of the first channel audio data which is being played via the second speaker.

Outputting, via the second speaker, the first frequency component of the second channel audio data, which has been switched from the first speaker may include fading in and outputting, via the second speaker, the first frequency component of the second channel audio data, which has been switched from the first speaker.

According to an embodiment, the electronic device may simultaneously perform steps 940 to 960.

Figure 10:
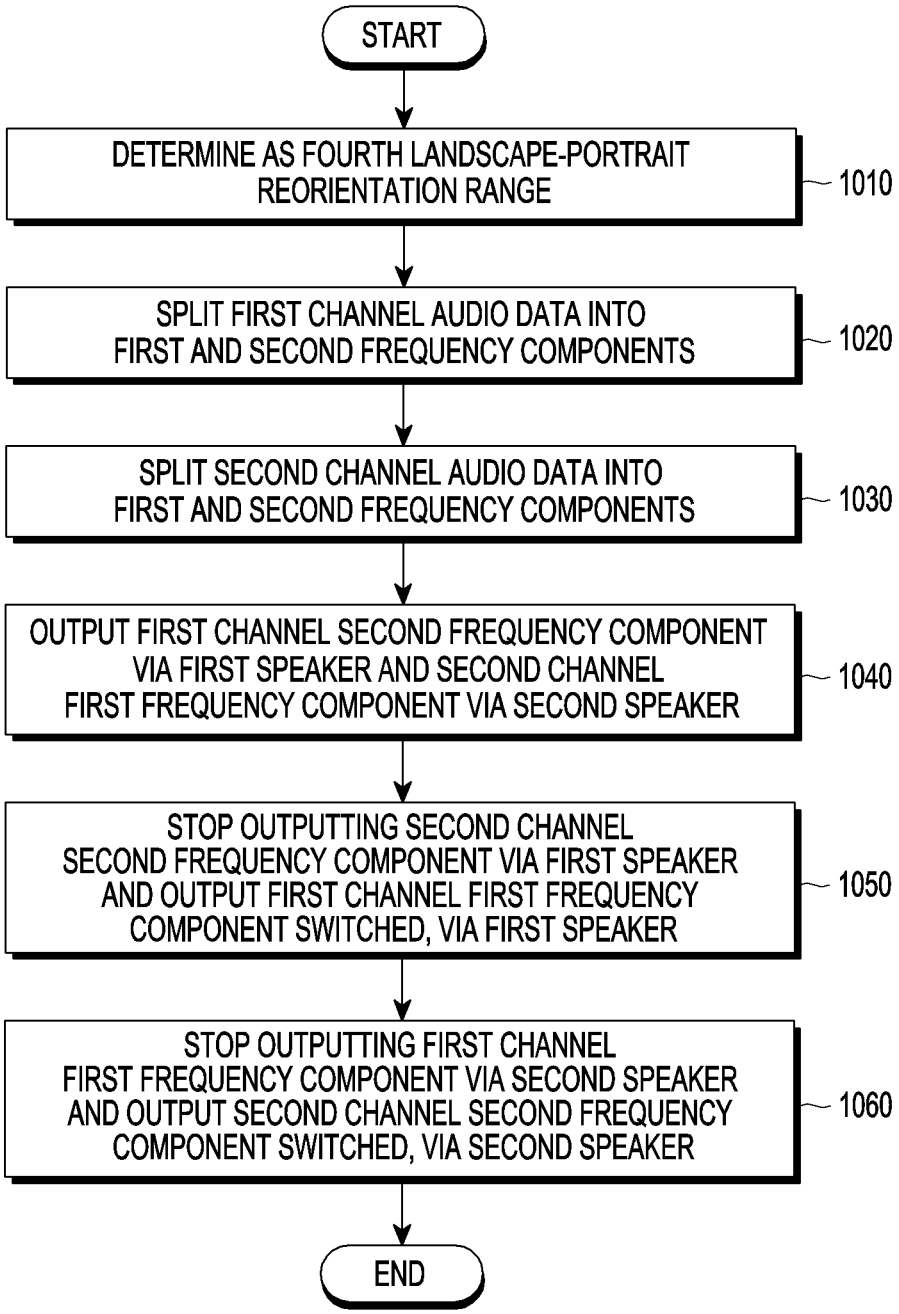
FIG. 10 is a flowchart of a method for playing audio on an electronic device according to an embodiment.

FIG. 10 is a flowchart of a method for playing audio using a dual speaker of an electronic device according to an embodiment. FIG. 10 is a flowchart of a method for playing crossed-over channel audio data according to step 650 as shown in FIG. 6. The method may be performed by at least one of an electronic device 401 or a processor 490, or the audio processor 477 of the electronic device.

Referring to FIG. 10, in step 1010, the electronic device may determine that the attitude angle of the electronic device is in the fourth landscape-portrait reorientation range. Step 1010 may be at least partially the same as step 640 of FIG. 6.

In step 1020, the electronic device may split the first channel audio data into a first frequency component and a second frequency component.

In step 1030, the electronic device may split the second channel audio data into a first frequency component and a second frequency component. Steps 1020 and 1030 may be the same as steps 720 and 730 of FIG. 7 described above, thus, no detailed description thereof is given below.

In step 1040, the electronic device may output the second frequency component of the first channel audio data via the first speaker and the first frequency component of the second channel audio data via the second speaker.

In step 1050, while continuing to output the second frequency component of the first channel audio data and the first frequency component of the second channel audio data via the first and second speakers in step 1040, the electronic device may stop outputting the second frequency component of the second channel audio data via the first speaker and output the first frequency component of the first channel audio data, which has been switched from the second speaker, via the first speaker.

Outputting the second frequency component of the second channel audio via the first speaker may include fading out the second frequency component of the second channel audio data which is being played via the first speaker.

Outputting, via the first speaker, the first frequency component of the first channel audio data, which has been switched from the second speaker may include fading in and outputting, via the first speaker, the first frequency component of the first channel audio data, which has been switched from the second speaker.

In step 1060, the electronic device may stop outputting the first frequency component of the first channel audio data via the second speaker and output the second frequency component of the second channel audio data, which has been switched from the first speaker, via the second speaker.

Stopping the output of the first frequency component of the first channel audio data via the second speaker may include fading out the first frequency component of the first channel audio data which is being played via the second speaker.

Outputting, via the second speaker, the second frequency component of the second channel audio data, which has been switched from the first speaker may include fading in and outputting, via the second speaker, the second frequency component of the second channel audio data, which has been switched from the first speaker.

According to an embodiment, the electronic device may simultaneously perform steps 1040 to 1060.

Figure 11:
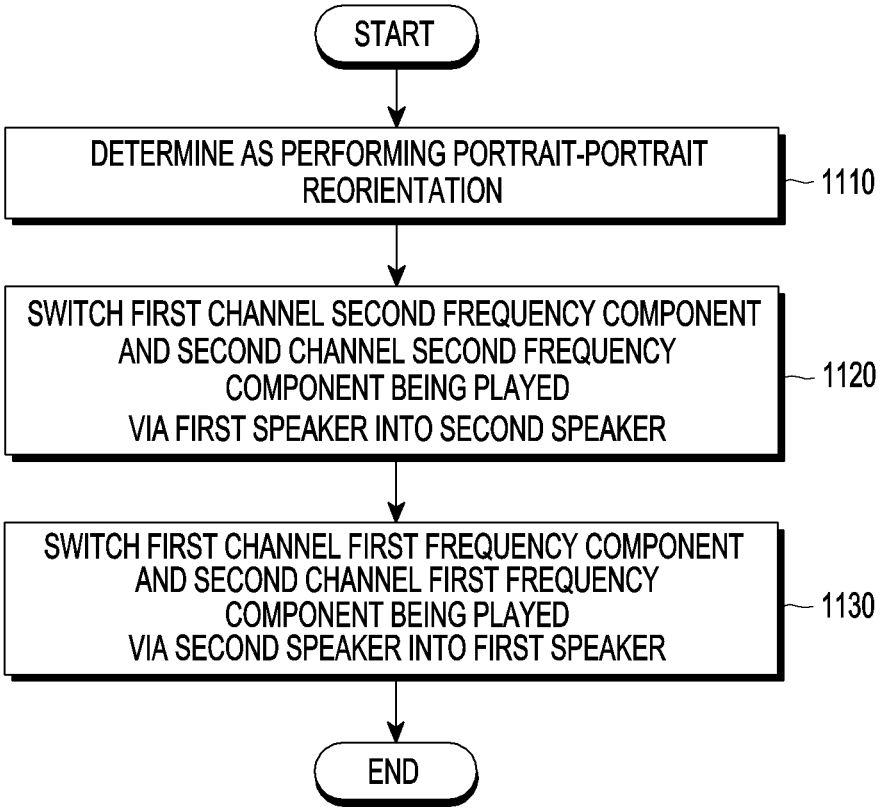
FIG. 11 is a flowchart of a method for playing audio on an electronic device according to an embodiment.

FIG. 11 is a flowchart of a method for playing audio using a dual speaker of an electronic device according to an embodiment. FIG. 11 is a flowchart of a method for playing channel-switched audio data according to step 670 as shown in FIG. 6. The method may be performed by at least one of an electronic device 401 or a processor 490, or the audio processor 477 of the electronic device.

Referring to FIG. 11, in step 1110, the electronic device may determine that the electronic device performs portrait-portrait reorientation. Step 1110 may be at least partially the same as step 640 of FIG. 6.

Referring to FIG. 11, in step 1120, upon determining that the electronic device performs portrait-portrait reorientation in step 1110, the electronic device may switch the second frequency component of the first channel audio data and the second frequency component of the second channel audio data, which have been crossed over and are being played via the first speaker, into the second speaker.

In step 1130, the electronic device may switch the first frequency component of the first channel audio data and the first frequency component of the second channel audio data which have been crossed over and are being played via the second speaker into the first speaker.

According to an embodiment, the electronic device may simultaneously perform steps 1120 and 1130.

Figure 12:
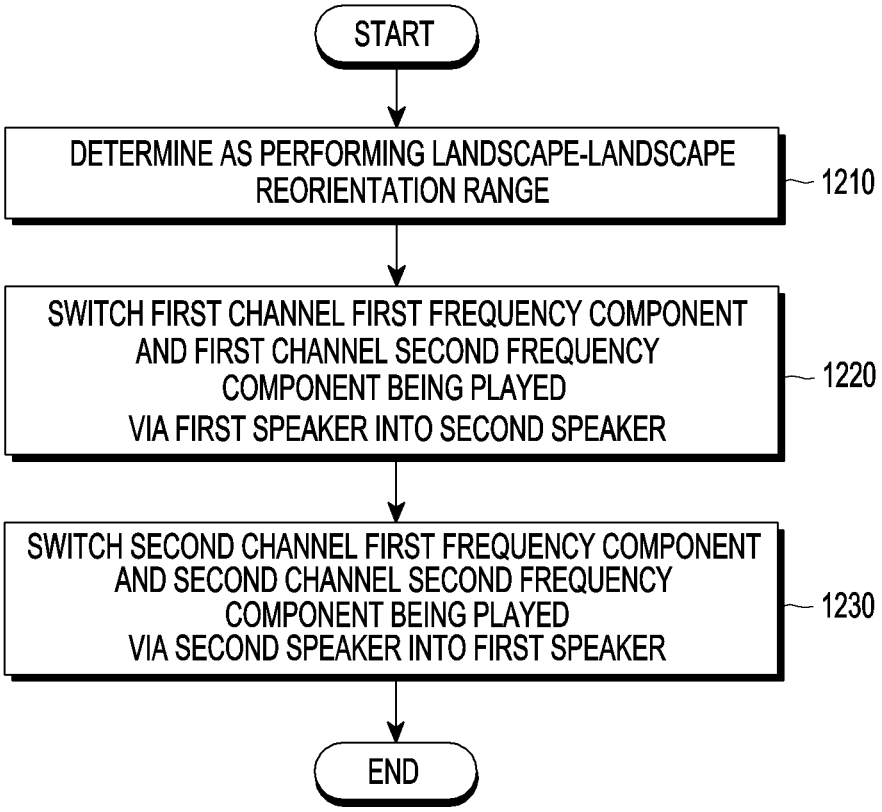
FIG. 12 is a flowchart of a method for playing audio on an electronic device according to an embodiment.

FIG. 12 is a flowchart of a method for playing audio using a dual speaker of an electronic device according to an embodiment. FIG. 12 is a flowchart of a method for playing channel-switched audio data according to step 670 as shown in FIG. 6. The method may be performed by at least one of an electronic device 401 or a processor 490, or the audio processor 477 of the electronic device.

Referring to FIG. 12, in step 1210, the electronic device may determine that the electronic device performs landscape-landscape reorientation. Step 1210 may be at least partially the same as step 640 of FIG. 6 described above, thus, no detailed description thereof is given below.

In step 1220, upon determining that the electronic device performs landscape-landscape reorientation in step 1210, the electronic device may switch the first frequency component of the first channel audio data and the second frequency component of the first channel audio data, which are being played via the first speaker, into the second speaker.

In step 1230, the electronic device may switch the first frequency component of the second channel audio data and the second frequency component of the second channel audio data, which are being played via the second speaker, into the first speaker.

According to an embodiment, the electronic device may simultaneously perform steps 1220 and 1230.

The non-transitory computer-readable storage medium may include a hardware device, such as hard discs, floppy discs, and magnetic tapes (e.g., a magnetic tape), optical media such as CD-ROMs and digital versatile discs (DVDs), magneto-optical media such as floptical disks, read only memories (ROMs), random access memories (RAMs), flash memories, and/or the like. Examples of the program instructions may include not only machine language code but also high-level language code which are executable by various computing means using an interpreter. The aforementioned hardware devices may be configured to operate as one or more software modules to carry out embodiments of the present disclosure, and vice versa.

As is apparent from the foregoing description, according to the present disclosure, the electronic device may keep on playing part of audio data upon changing its orientation or attitude while playing the audio data via its dual speaker, which enables a smooth reorientation of the electronic device without sound dropouts.

According to the present disclosure, the electronic device may fade in or out at least some frequency components, of audio data played via the dual speaker, which switch to another channel as the electronic device changes orientation or attitude, thus delivering seamless stereoscopic sound effects while changing orientation or attitude.

The embodiments disclosed herein are for description and understanding of the present disclosure but are not intended to limit the scope of the present disclosure. While the present disclosure has been shown and described with reference to certain embodiments thereof, it will be understood by those skilled in the art that various changes in form and details may be made therein without departing from the spirit and scope of the present disclosure as defined by the appended claims and their equivalents.

What is claimed is:

1. An electronic device, comprising:

a first speaker and a second speaker arranged in the electronic device;

a processor operatively connected with the first speaker and the second speaker; and a memory operatively connected to the processor, wherein the memory is configured to store instructions executable to enable the processor to:

detect an orientation or attitude of the electronic device while playing first channel audio data and second channel audio data via the first speaker and the second speaker, respectively, and based on at least part of the detected orientation or attitude of the electronic device, keep outputting a first frequency component of the first channel audio data and a second frequency component of the second channel audio data via the first speaker and the second speaker, respectively, and switch a second frequency component of the first channel audio data and a first frequency component of the second channel audio data.

2. The electronic device of claim 1, wherein the memory is further configured to store instructions executable to enable the processor to, based on at least part of the orientation or attitude of the electronic device, while outputting the first frequency component of the first channel audio data via the first speaker and the second frequency component of the second channel audio data via the second speaker:

stop outputting the second frequency component of the first channel audio data via the first speaker and output the first frequency component of the second channel audio data switched from the second speaker via the first speaker, and stop outputting the first frequency component of the second channel audio data via the second speaker and output the second frequency component of the first channel audio data switched from the first speaker via the second speaker.

3. The electronic device of claim 1, wherein the memory is further configured to store instructions executable to enable the processor to, based on at least part of the orientation or attitude of the electronic device, while outputting the first frequency component of the first channel audio data via the first speaker and the second frequency component of the second channel audio data via the second speaker:

fade out the second frequency component of the first channel audio data output via the first speaker, and fade in and output, via the first speaker, the first frequency component of the second channel audio data switched from the second speaker, and fade out the first frequency component of the second channel audio data output via the second speaker, and fade in and output, via the second speaker, the second frequency component of the first channel audio data switched from the first speaker.

4. The electronic device of claim 1, wherein the memory is further configured to store instructions executable to enable the processor to, based on at least part of the orientation of the electronic device, while outputting the second frequency component of the second channel audio data via the first speaker and the first frequency component of the first channel audio data via the second speaker:

stop outputting the first frequency component of the second channel audio data via the first speaker and output the second frequency component of the first channel audio data switched from the second speaker via the first speaker, and stop outputting the second frequency component of the first channel audio data via the second speaker and output the first frequency component of the second channel audio data switched from the first speaker via the second speaker.

5. The electronic device of claim 1, wherein the memory is further configured to store instructions executable to enable the processor to, based on at least part of the orientation of the electronic device, while outputting the second frequency component of the second channel audio data via the first speaker and the first frequency component of the first channel audio data via the second speaker:

fade out the first frequency component of the second channel audio data output via the first speaker, and fade in and output, via the first speaker, the second frequency component of the first channel audio data switched from the second speaker, and fade out the second frequency component of the first channel audio data output via the second speaker, and fade in and output, via the second speaker, the first frequency component of the second channel audio data switched from the first speaker.

6. The electronic device of claim 1, wherein the memory is further configured to store instructions executable to enable the processor to:

based on at least part of the detected orientation of the electronic device, keep outputting the second frequency component of the first channel audio data and the first frequency component of the second channel audio data via the first speaker and the second speaker, respectively, and switch the first frequency component of the first channel audio data and the second frequency component of the second channel audio data.

7. The electronic device of claim 6, wherein the memory is further configured to store instructions executable to enable the processor to, based on at least part of the orientation of the electronic device, while outputting the first frequency component of the second channel audio data via the first speaker and the second frequency component of the first channel audio data via the second speaker:

stop outputting the first frequency component of the first channel audio data via the first speaker and output the second frequency component of the second channel audio data switched from the second speaker via the first speaker, and stop outputting the second frequency component of the second channel audio data via the second speaker and output the first frequency component of the first channel audio data switched from the first speaker via the second speaker.

8. The electronic device of claim 6, wherein the memory is further configured to store instructions executable to enable the processor to, based on at least part of the orientation of the electronic device, while outputting the first frequency component of the second channel audio data via the first speaker and the second frequency component of the first channel audio data via the second speaker:

fade out the first frequency component of the first channel audio data output via the first speaker, and fade in and output, via the first speaker, the second frequency component of the second channel audio data switched from the second speaker, and fade out the second frequency component of the second channel audio data output via the second speaker, and fade in and output, via the second speaker, the first frequency component of the first channel audio data switched from the first speaker.

9. The electronic device of claim 6, wherein the memory is further configured to store instructions executable to enable the processor to, based on at least part of the orientation of the electronic device, while outputting the second frequency component of the first channel audio data via the first speaker and the first frequency component of the second channel audio data via the second speaker:

stop outputting the second frequency component of the second channel audio data via the first speaker and output the first frequency component of the first channel audio data switched from the second speaker via the first speaker, and stop outputting the first frequency component of the first channel audio data via the second speaker and output the second frequency component of the second channel audio data switched from the first speaker via the second speaker.

10. The electronic device of claim 6, wherein the memory is further configured to store instructions executable to enable the processor to, based on at least part of the orientation of the electronic device, while outputting the second frequency component of the first channel audio data via the first speaker and the first frequency component of the second channel audio data via the second speaker:

fade out the second frequency component of the second channel audio data output via the first speaker, and fade in and output, via the first speaker, the first frequency component of the first channel audio data switched from the second speaker, and fade out the first frequency component of the first channel audio data output via the second speaker, and fade in and output, via the second speaker, the second frequency component of the second channel audio data switched from the first speaker.

11. A method for playing audio data on an electronic device, the method comprising:

detecting an orientation or attitude of the electronic device while playing first channel audio data and second channel audio data via the first speaker and the second speaker, respectively;

based on at least part of the detected orientation or attitude of the electronic device, keeping outputting a first frequency component of the first channel audio data and a second frequency component of the second channel audio data via the first speaker and the second speaker, respectively; and switching a second frequency component of the first channel audio data and a first frequency component of the second channel audio data.

12. The method of claim 11, wherein switching the second frequency component of the first channel audio data and the first frequency component of the second channel audio data comprises, while outputting the first frequency component of the first channel audio data via the first speaker and the second frequency component of the second channel audio data via the second speaker:

stopping outputting the second frequency component of the first channel audio data via the first speaker;

outputting the first frequency component of the second channel audio data switched from the second speaker via the first speaker;

stopping outputting the first frequency component of the second channel audio data via the second speaker; and outputting the second frequency component of the first channel audio data switched from the first speaker via the second speaker.

13. The method of claim 11, wherein switching the second frequency component of the first channel audio data and the first frequency component of the second channel audio data comprises, based on at least part of the orientation of the electronic device, while outputting the second frequency component of the second channel audio data via the first speaker and the first frequency component of the first channel audio data via the second speaker:

stopping outputting the first frequency component of the second channel audio data via the first speaker;

outputting the second frequency component of the first channel audio data switched from the second speaker via the first speaker;

stopping outputting the second frequency component of the first channel audio data via the second speaker; and outputting the first frequency component of the second channel audio data switched from the first speaker via the second speaker.

14. The method of claim 13, further comprising:

based on at least part of the detected orientation of the electronic device, keeping outputting the second frequency component of the first channel audio data and the first frequency component of the second channel audio data via the first speaker and the second speaker, respectively; and switching the first frequency component of the first channel audio data and the second frequency component of the second channel audio data.

15. The method of claim 14, wherein switching the first frequency component of the first channel audio data and the second frequency component of the second channel audio data comprises, while outputting the first frequency component of the second channel audio data via the first speaker and the second frequency component of the first channel audio data via the second speaker;

stopping outputting the first frequency component of the first channel audio data via the first speaker;

outputting the second frequency component of the second channel audio data switched from the second speaker via the first speaker;

stopping outputting the second frequency component of the second channel audio data via the second speaker; and outputting the first frequency component of the first channel audio data switched from the first speaker via the second speaker.

16. A non-transitory computer-readable recording medium recording a program running on a computer, wherein the program comprises instructions executable by a processor to enable the processor to:

detect an orientation or attitude of an electronic device while playing first channel audio data and second channel audio data via a first speaker and a second speaker of the electronic device, respectively, based on at least part of the detected orientation or attitude of the electronic device, keep outputting a first frequency component of the first channel audio data and a second frequency component of the second channel audio data via the first speaker and the second speaker, respectively, and switch a second frequency component of the first channel audio data and a first frequency component of the second channel audio data.

17. The non-transitory computer-readable recording medium of claim 16, wherein the program further comprises instructions executable by the processor to enable the processor to, upon switching the second frequency component of the first channel audio data and the first frequency component of the second channel audio data, while outputting the first frequency component of the first channel audio data via the first speaker and the second frequency component of the second channel audio data via the second speaker:

stop outputting the second frequency component of the first channel audio data via the first speaker, output the first frequency component of the second channel audio data switched from the second speaker via the first speaker, stop outputting the first frequency component of the second channel audio data via the second speaker, and output the second frequency component of the first channel audio data switched from the first speaker via the second speaker.

18. The non-transitory computer-readable recording medium of claim 17, wherein the program further comprises instructions executable by the processor to enable the processor to, upon switching the second frequency component of the first channel audio data and the first frequency component of the second channel audio data, based on at least part of the orientation of the electronic device, while outputting the second frequency component of the second channel audio data via the first speaker and the first frequency component of the first channel audio data via the second speaker:

stop outputting the first frequency component of the second channel audio data via the first speaker, output the second frequency component of the first channel audio data switched from the second speaker via the first speaker, stop outputting the second frequency component of the first channel audio data via the second speaker, and output the first frequency component of the second channel audio data switched from the first speaker via the second speaker.

19. The non-transitory computer-readable recording medium of claim 18, wherein the program further comprises instructions executable by the processor to enable the processor to:

based on at least part of the detected orientation of the electronic device, keep outputting the second frequency component of the first channel audio data and the first frequency component of the second channel audio data via the first speaker and the second speaker, respectively, and switch the first frequency component of the first channel audio data and the second frequency component of the second channel audio data.

20. The non-transitory computer-readable recording medium of claim 19, wherein the program further comprises instructions executable by the processor to enable the processor to, upon switching the first frequency component of the first channel audio data and the second frequency component of the second channel audio data, while outputting the second frequency component of the first channel audio data via the first speaker and the first frequency component of the second channel audio data via the second speaker:

stop outputting the second frequency component of the second channel audio data via the first speaker, output the first frequency component of the first channel audio data switched from the second speaker via the first speaker, stop outputting the first frequency component of the first channel audio data via the second speaker, and output the second frequency component of the second channel audio data switched from the first speaker via the second speaker.

* * * * *